US008113786B2

(12) United States Patent
Spracher et al.

(10) Patent No.: US 8,113,786 B2
(45) Date of Patent: Feb. 14, 2012

(54) STATOR VANE PROFILE OPTIMIZATION

(75) Inventors: David Randolph Spracher, Simpsonville, SC (US); John Anthony Mart, II, Greer, SC (US); Peter Samuel King, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 824 days.

(21) Appl. No.: 12/209,355

(22) Filed: Sep. 12, 2008

(65) Prior Publication Data

US 2010/0068048 A1 Mar. 18, 2010

(51) Int. Cl.
*F01D 9/00* (2006.01)

(52) U.S. Cl. ..... 416/223 R; 416/223 A; 416/DIG. 2; 415/191; 415/208.1

(58) Field of Classification Search ..... 416/223 R, 416/223 A, DIG. 2; 415/191, 208.1
See application file for complete search history.

(56) References Cited

U.S. PATENT DOCUMENTS

| | | | | |
|---|---|---|---|---|
| 5,980,209 | A | 11/1999 | Barry et al. | |
| 6,854,961 | B2 | 2/2005 | Zhang et al. | |
| 6,857,855 | B1 | 2/2005 | Snook et al. | |
| 6,881,038 | B1 | 4/2005 | Beddard et al. | |
| 6,887,041 | B2 | 5/2005 | Coke et al. | |
| 6,994,520 | B2 | 2/2006 | Humanchuk et al. | |
| 7,094,034 | B2 | 8/2006 | Fukuda et al. | |
| 7,384,243 | B2 | 6/2008 | Noshi | |
| 7,396,211 | B2 | 7/2008 | Tomberg et al. | |
| 7,467,926 | B2 * | 12/2008 | Stampfli et al. | 416/223 A |
| 7,517,188 | B2 * | 4/2009 | McGowan et al. | 415/162 |
| 7,517,190 | B2 * | 4/2009 | Latimer et al. | 415/191 |
| 7,976,280 | B2 * | 7/2011 | Brittingham et al. | 416/189 |
| 8,007,245 | B2 * | 8/2011 | Brittingham et al. | 416/239 |
| 8,057,186 | B2 * | 11/2011 | Brittingham | 416/189 |

* cited by examiner

*Primary Examiner* — Igor Kershteyn
(74) *Attorney, Agent, or Firm* — Armstrong Teasdale LLP

(57) ABSTRACT

An airfoil for a stator vane having an uncoated profile substantially in accordance with Cartesian coordinate values of X, Y and Z set forth in Table I is provided. The profile is carried only to three decimal places wherein Z is a distance from a platform on which the airfoil is mounted and X and Y are coordinates defining the profile at each distance Z from the platform.

17 Claims, 5 Drawing Sheets

STATOR VANE PROFILE OPTIMIZATION

BACKGROUND OF THE INVENTION

The present invention relates generally to stator vanes for gas turbines and, more particularly, to a novel and improved profile for a third stage stator vane.

In the design, fabrication and use of turbine engines, there has been an increasing tendency toward operating with higher temperatures and higher operating pressures to optimize turbine performance. Also, as existing turbine airfoils and stator vanes reach the end of their life cycle, it is desirable to replace the airfoils, while simultaneously enhancing performance of the gas turbine through redesign of the airfoils to accommodate the increased operating temperatures and pressures.

Airfoil profiles for gas turbines have been proposed to provide improved performance, lower operating temperatures, increased creep margin and extended life in relation to conventional airfoils. See, for example, U.S. Pat. No. 5,980,209 describing an enhanced turbine blade airfoil profile. Advanced materials and new steam cooling systems now permit gas turbines to operate at, and accommodate, much higher operating temperatures, mechanical loading, and pressures than is capable in at least some known turbine engines. As a result, many system requirements must be met for each stage of each compressor used with the turbine engines in order to meet design goals including overall improved efficiency and airfoil loading. Particularly, the airfoils of the stator vanes positioned within the compressors must meet the thermal and mechanical operating requirements for each particular stage.

Past efforts to meet design goals and desired requirements have provided coatings on the airfoil, but such coatings may not be robust enough or permanent to provide design goals and desired requirements. Accordingly, it is desirable to provide an airfoil configuration with a profile meet to design goals and desired requirements.

BRIEF DESCRIPTION OF THE INVENTION

In one aspect, an airfoil for a stator vane is provided. The airfoil has an uncoated profile substantially in accordance with Cartesian coordinate values of X, Y and Z set forth in Table I carried only to four decimal places wherein Z is a distance from a platform on which the airfoil is mounted and X and Y are distances which, when connected by smooth continuing arcs, define airfoil profile sections at each distance Z from the platform.

In another aspect, a compressor comprising at least one row of stator vanes is provided. Each of the stator vanes comprises a base and an airfoil extending therefrom. Each of the vanes includes an airfoil having an airfoil shape. The airfoil shape has a nominal profile substantially in accordance with Cartesian coordinate values of X, Y and Z set forth in Table I carried only to three decimal places wherein Z is a distance from a platform on which the airfoil is mounted and X and Y are coordinates defining the profile at each distance Z from the platform. The X and Y distances are scalable as a function of a constant to provide a scaled-up or scaled-down airfoil.

In a further aspect, a stator assembly is provided. The stator assembly includes at least one stator vane including a base and an airfoil extending from the base. The airfoil has an uncoated profile substantially in accordance with Cartesian coordinate values of X, Y and Z set forth in Table I carried only to three decimal places wherein Z is a distance from a platform on which the airfoil is mounted and X and Y are coordinates defining the profile at each distance Z from the base. The profile is scalable by a predetermined constant n and manufacturable to a predetermined manufacturing tolerance.

DETAILED DESCRIPTION OF THE INVENTION

In one embodiment, an article of manufacture has a nominal profile substantially in accordance with Cartesian coordinate values of X, Y and Z set forth in TABLE A, and wherein X and Y are distances in inches which, when connected by smooth continuing arcs, define airfoil profile sections at each distance Z in inches, the profile sections at the Z distances being joined smoothly with one another to form a complete airfoil shape.

In another embodiment, there is provided an airfoil compressor shape for a vane of a gas turbine that enhances the performance of the gas turbine. The airfoil shape hereof also improves the interaction between various stages of the compressor and affords improved aerodynamic efficiency, while simultaneously reducing stage airfoil thermal and mechanical stresses.

The vane airfoil profile, as embodied by the present invention, is defined by a unique loci of points that facilitates achieving the necessary efficiency and loading requirements whereby improved compressor performance is obtained. These unique loci of points define the nominal airfoil profile and are identified by the X, Y and Z Cartesian coordinates of the TABLE A that follows. The points for the coordinate values shown in TABLE A are relative to the engine centerline and for a cold, i.e., room temperature vane at various cross-sections of the vane's airfoil along its length. The positive X, Y and Z directions are axial toward the exhaust end of the turbine, tangential in the direction of engine rotation and radially outwardly toward the static case, respectively. The X, Y, and Z coordinates are given in distance dimensions, e.g., units of inches, and are joined smoothly at each Z location to form a smooth continuous airfoil cross-section. Each defined airfoil section in the X, Y plane is joined smoothly with adjacent airfoil sections in the Z direction to form the complete airfoil shape.

It will be appreciated that an airfoil heats up during use, as known by a person of ordinary skill in the art. The airfoil profile will thus change as a result of mechanical loading and temperature. Accordingly, the cold or room temperature profile, for manufacturing purposes, is given by X, Y and Z coordinates. A distance of plus or minus about 0.160 inches (+/−0.160") from the nominal profile in a direction normal to any surface location along the nominal profile and which includes any coating, defines a profile envelope for this vane airfoil, because a manufactured vane airfoil profile may be different from the nominal airfoil profile given by the following tables. The airfoil shape is robust to this variation, without impairment of the mechanical and aerodynamic functions of the vane.

Figure 1:
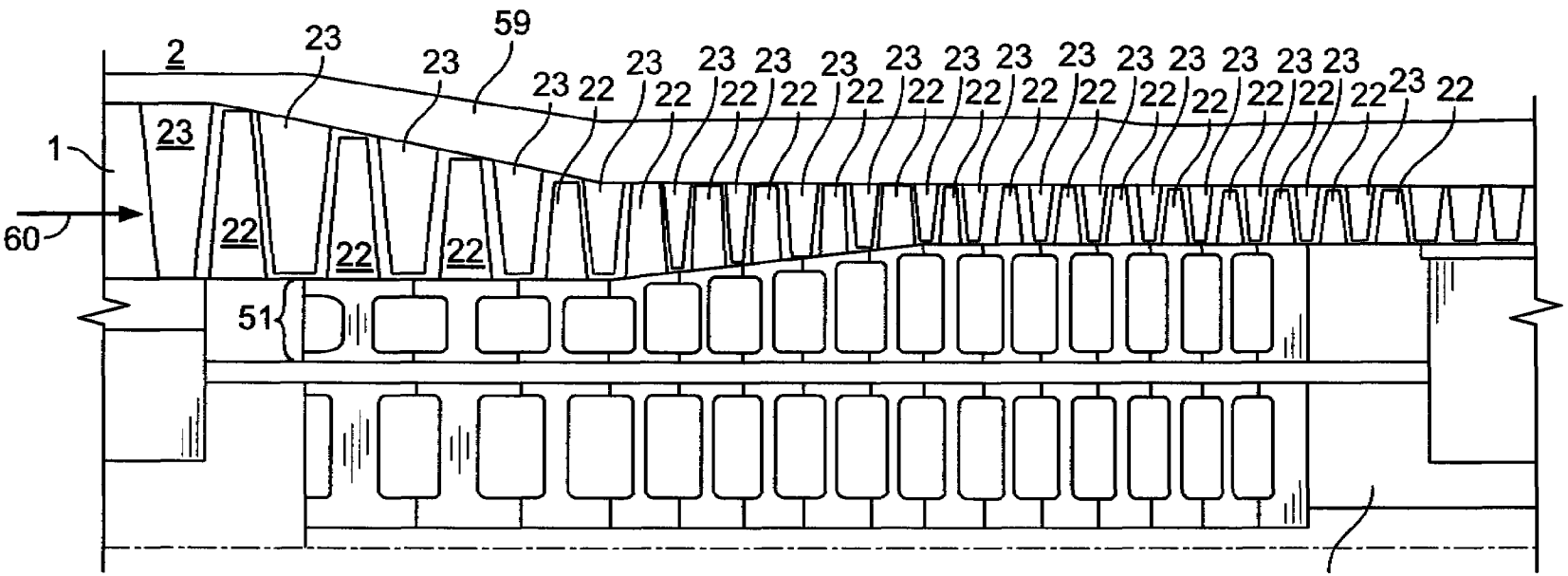
FIG. 1 is schematic illustration of an compressor flow path defined through multiple stages of an exemplary gas turbine.
Figure 4:
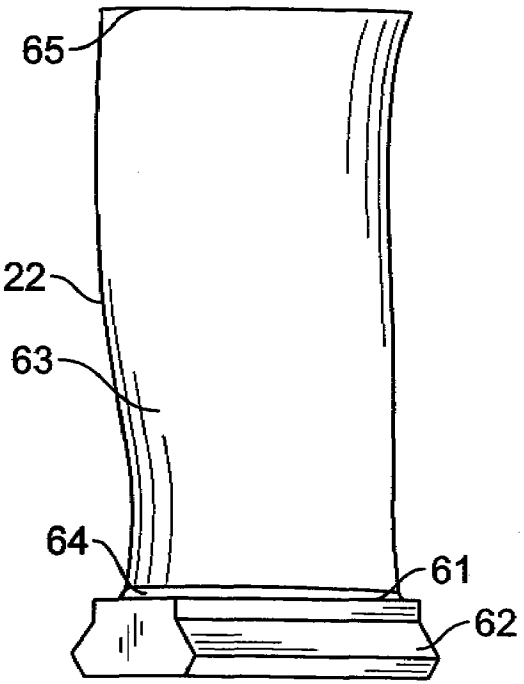
FIG. 4 is a side elevational view of the vane airfoil shown in FIGS. 2 and 3 as viewed in a generally circumferential direction from the pressure side of the airfoil.
Figure 3:
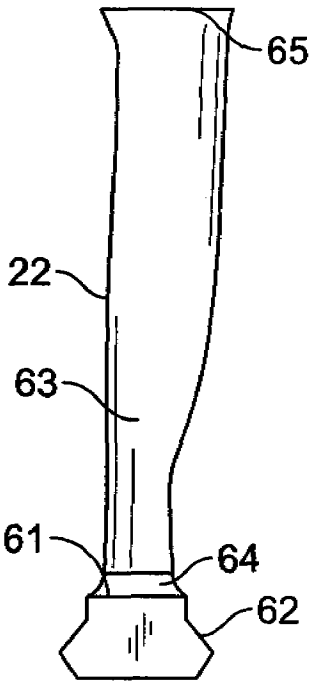
FIG. 3 is another perspective view of the vane airfoil shown in FIG. 2.
Figure 2:
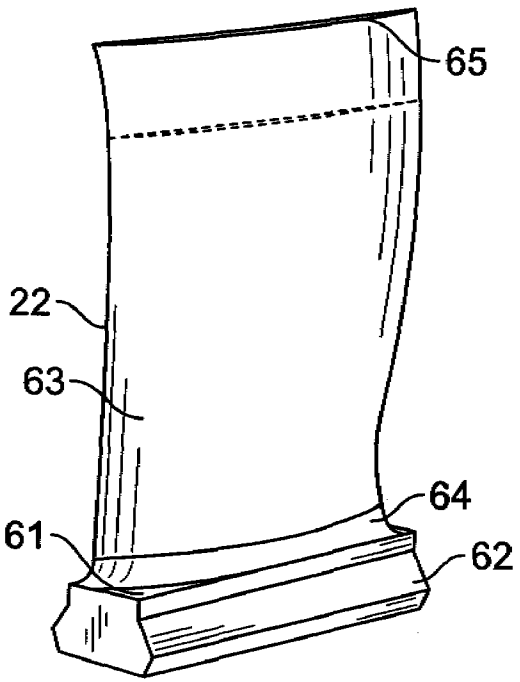
FIG. 2 is a perspective view of a vane airfoil used with the gas turbine engine shown in FIG. 1.
Figure 5:
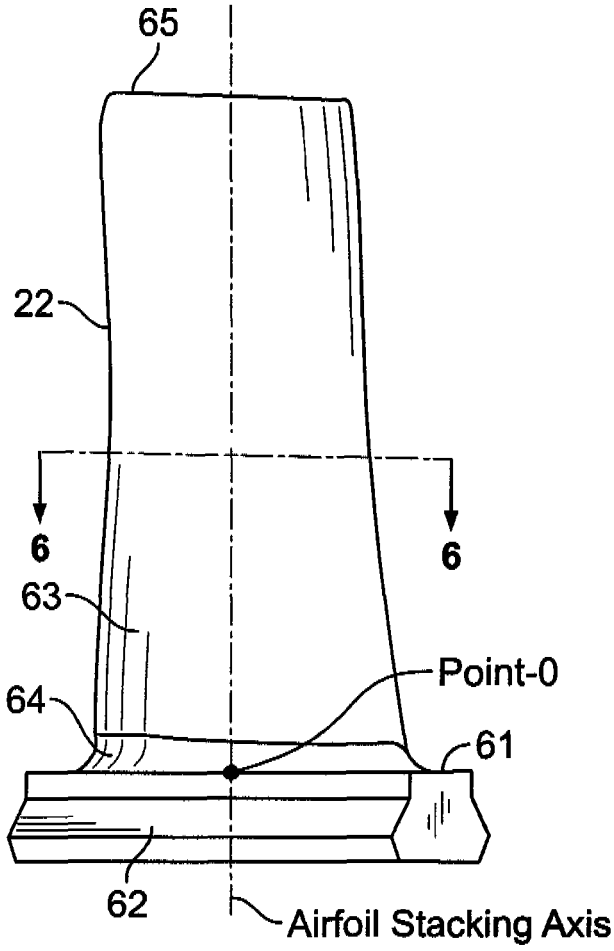
FIG. 5 is a side elevational view of the vane airfoil shown in FIG. 4 as viewed in a generally circumferential direction from the suction side of the airfoil.
Figure 6:
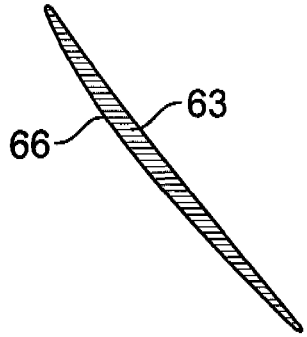
FIG. 6 is a cross-sectional view of the vane airfoil taken generally about on line 6-6 in FIG. 5.
Figure 8:
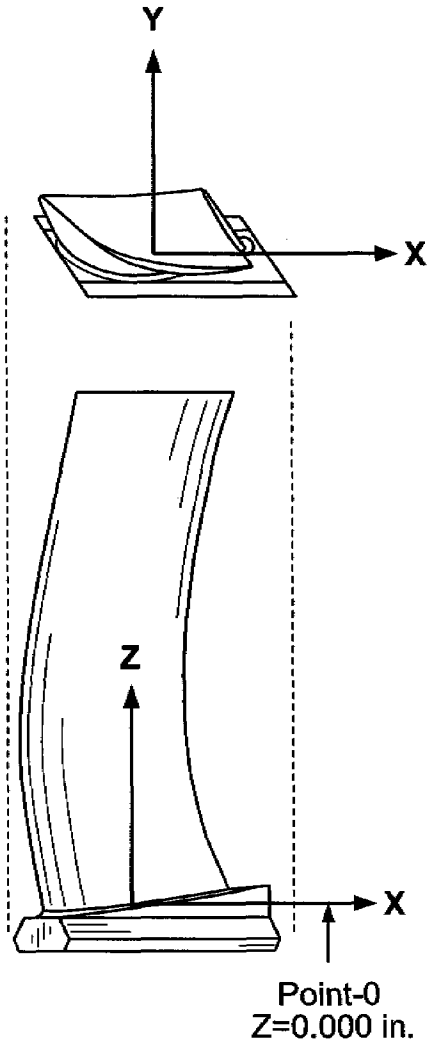
FIG. 8 is another side view of the vane airfoil shown in FIGS. 2 and 3.
Figure 7:
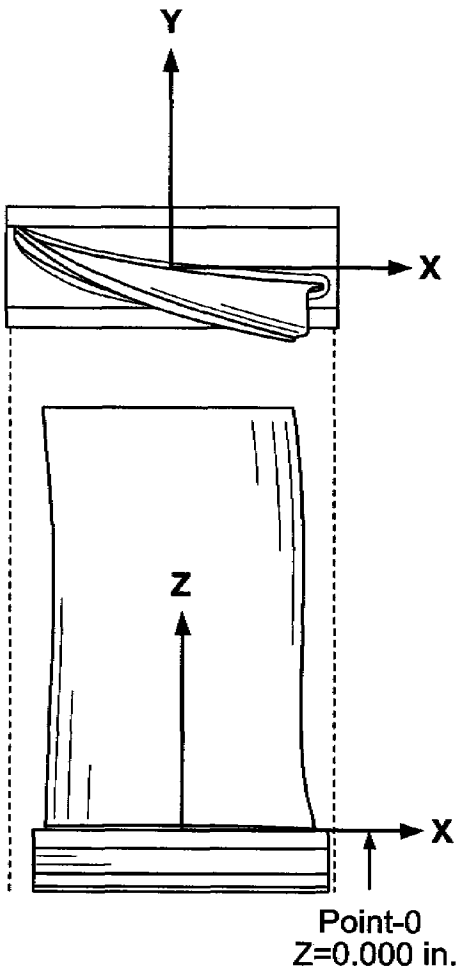
FIG. 7 is a side view of the vane airfoil shown in FIGS. 2 and 3.

Referring now to the Figures, FIG. 1 illustrates an exemplary axial compressor flow path 10 defined within a gas turbine compressor 12 that includes a plurality of compressor stages. For example, and as illustrated in FIG. 1, compressor 12 may include seventeen compressor stages. Compressor flow path 10 may include any number of rotor stages and stator stages that enables compressor 12 to function as described herein. As such, the seventeen stages illustrated in FIG. 1 are merely exemplary of one turbine design, and the number of stages is not intended to limit the invention in any manner.

As is known, compressor vanes impart kinetic energy to the airflow and therefore bring about a desired pressure rise. Immediately downstream from the rotor airfoils is a stage of stator airfoils. Both the rotor and stator airfoils turn the airflow, slow the airflow velocity (in the respective airfoil frame of reference), and yield a rise in the static pressure of the airflow. Typically, multiple rows of rotor/stator stages are stacked in axial flow compressors to achieve a desired discharge to inlet pressure ratio. Rotor and stator airfoils can be secured to rotor wheels or stator case by an appropriate attachment configuration, often known as a "root", "base" or "dovetail" (see FIGS. 2-5).

An exemplary stage of compressor 12 is illustrated in FIG. 1. Each stage of compressor 12 includes a plurality of circumferentially-spaced blades 22 coupled to a rotor wheel 51 and a plurality of circumferentially-spaced stator vanes 23 coupled to a static compressor case 59. The plurality of circumferentially-spaced stator vanes 22 cooperate with the plurality of circumferentially-spaced blades 20. Each rotor wheel 51 is coupled to an aft drive shaft 58 that is coupled to a turbine section of the engine. The plurality of circumferentially-spaced blades 20 and stator vanes 22 are each positioned in compressor flow path 10. The direction of airflow through compressor flow path 10 is indicated by an arrow 60 in FIG. 1.

Figure 9:
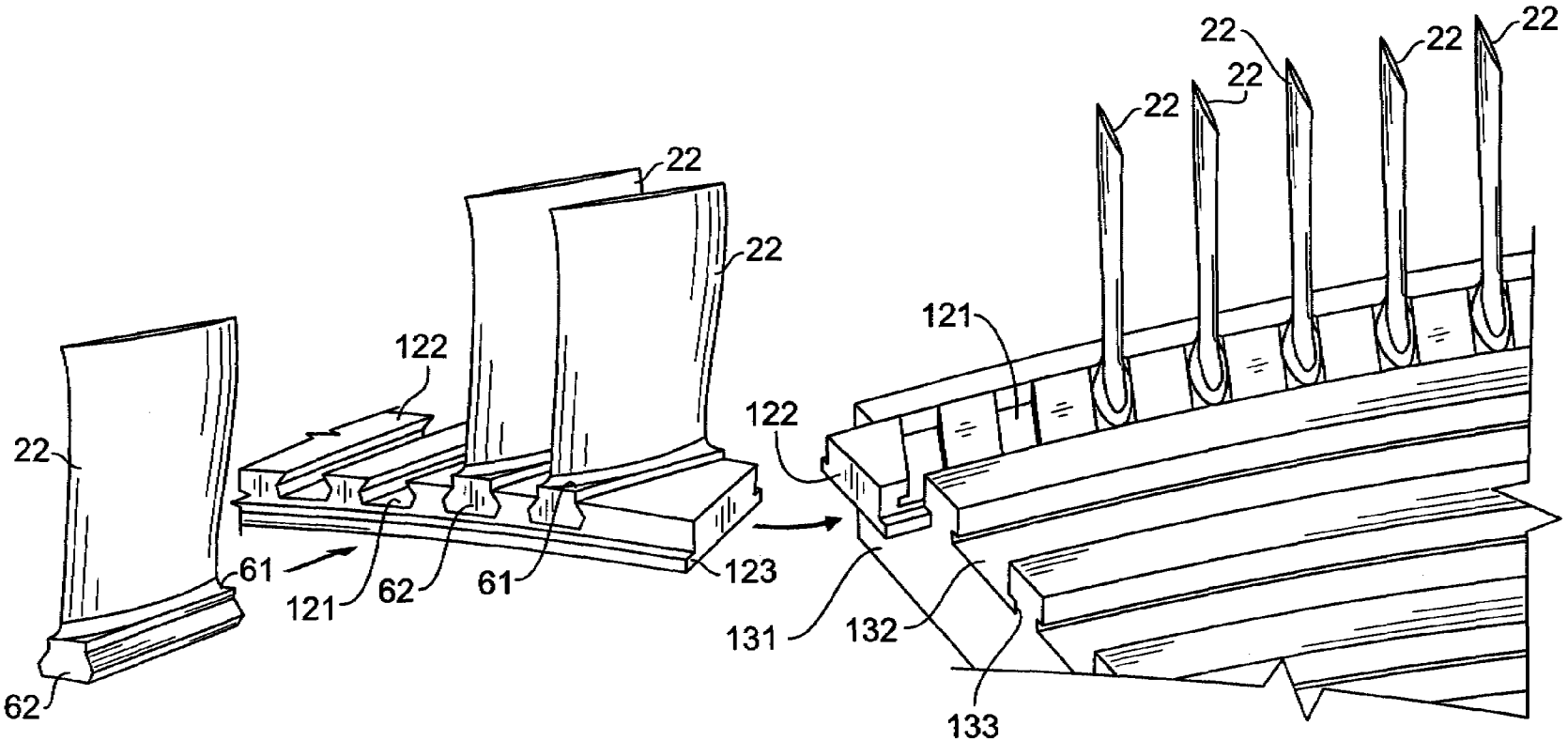
FIG. 9 is a schematic view of an exemplary vane, ring, and casing configuration that may be used with the gas turbine shown in FIG. 1.

In the exemplary embodiment, as shown in FIGS. 5 and 7-9, includes a platform 61 and a dovetail 62. Moreover, and as shown in FIG. 9, in an alternative embodiment, each vane 22 may be inserted into a cutout 121 defined in a ring 122 that is then inserted into a slot 132 defined in a casing 131. In the exemplary embodiment, ring 122 includes a tab 123 that is inserted into slot 133 defined in casing 131. The exemplary arrangement illustrated in FIG. 9, facilitates a stable and secure mounting of vanes 22.

To define the airfoil shape of the vane airfoil, a unique set or loci of points in space are provided. This unique set or loci of points satisfy the stage requirements so the stage can be manufactured. This unique loci of points also satisfies the desired requirements for stage efficiency and reduced thermal and mechanical stresses. In the exemplary embodiment, the loci of points are arrived at by iteration between aerodynamic and mechanical loadings enabling the compressor to run in an efficient, safe and smooth manner.

In the exemplary embodiment, the loci, as embodied by the invention, defines the vane airfoil profile and can comprise a set of points defined relative to the axis of rotation of the engine. For example, a set of points can be provided to define a vane airfoil profile. Furthermore, the vane airfoil profile, as embodied by the invention, can comprise vanes for a Stage 3 stator vane of a compressor.

A Cartesian coordinate system of X, Y and Z values given in TABLE A below defines a profile of a vane airfoil at various locations along its length. The coordinate values for the X, Y and Z coordinates are set forth in inches, although other units of dimensions may be used when the values are appropriately converted. These values exclude fillet regions of the platform. The Cartesian coordinate system has orthogonally-related X, Y and Z axes. The X axis lies parallel to the compressor rotor centerline, such as the rotary axis. A positive X coordinate value is axial toward the aft, for example the exhaust end of the compressor. A positive Y coordinate value directed aft extends tangentially in the direction of rotation of the rotor. A positive Z coordinate value is directed radially outward toward the static casing of compressor 12.

TABLE A values are generated and shown to three decimal places for determining the profile of the airfoil. There are typical manufacturing tolerances as well as coatings, which should be accounted for in the actual profile of the airfoil. Accordingly, the values for the profile given are for a nominal airfoil. It will therefore be appreciated that +/−typical manufacturing tolerances, such as, +/−values, including any coating thicknesses, are additive to the X and Y values. Therefore, a distance of about +/−0.160 inches in a direction normal to any surface location along the airfoil profile defines an airfoil profile envelope for a vane airfoil design and compressor. In other words, a distance of about +/−0.160 inches in a direction normal to any surface location along the airfoil profile defines a range of variation between measured points on the actual airfoil surface at nominal cold or room temperature and the ideal position of those points, at the same temperature, as embodied by the invention. The vane airfoil design, as embodied by the invention, is robust to this range of variation without impairment of mechanical and aerodynamic functions.

The coordinate values given in the TABLE A below provide the nominal profile envelope for an exemplary S3 stage stator.

TABLE A

| X | Y | Z |
|---|---|---|
| 1.7268 | 0.1234 | −0.2000 |
| 1.7271 | 0.1221 | −0.2000 |
| 1.7275 | 0.1194 | −0.2000 |
| 1.7275 | 0.1140 | −0.2000 |
| 1.7256 | 0.1058 | −0.2000 |
| 1.7167 | 0.0936 | −0.2000 |
| 1.6981 | 0.0856 | −0.2000 |
| 1.6722 | 0.0770 | −0.2000 |
| 1.6397 | 0.0664 | −0.2000 |
| 1.5976 | 0.0528 | −0.2000 |
| 1.5491 | 0.0366 | −0.2000 |
| 1.4976 | 0.0186 | −0.2000 |
| 1.4397 | −0.0018 | −0.2000 |
| 1.3753 | −0.0242 | −0.2000 |
| 1.3042 | −0.0483 | −0.2000 |
| 1.2297 | −0.0727 | −0.2000 |
| 1.1517 | −0.0974 | −0.2000 |
| 1.0701 | −0.1219 | −0.2000 |
| 0.9849 | −0.1462 | −0.2000 |
| 0.8960 | −0.1697 | −0.2000 |
| 0.8037 | −0.1921 | −0.2000 |
| 0.7077 | −0.2131 | −0.2000 |

TABLE A-continued

| X | Y | Z |
|---|---|---|
| 0.6080 | −0.2323 | −0.2000 |
| 0.5079 | −0.2487 | −0.2000 |
| 0.4074 | −0.2623 | −0.2000 |
| 0.3065 | −0.2728 | −0.2000 |
| 0.2051 | −0.2800 | −0.2000 |
| 0.1032 | −0.2836 | −0.2000 |
| 0.0007 | −0.2832 | −0.2000 |
| −0.1017 | −0.2790 | −0.2000 |
| −0.2035 | −0.2714 | −0.2000 |
| −0.3046 | −0.2603 | −0.2000 |
| −0.4051 | −0.2461 | −0.2000 |
| −0.5050 | −0.2289 | −0.2000 |
| −0.6010 | −0.2093 | −0.2000 |
| −0.6932 | −0.1876 | −0.2000 |
| −0.7815 | −0.1641 | −0.2000 |
| −0.8660 | −0.1389 | −0.2000 |
| −0.9469 | −0.1121 | −0.2000 |
| −1.0240 | −0.0840 | −0.2000 |
| −1.0972 | −0.0550 | −0.2000 |
| −1.1629 | −0.0262 | −0.2000 |
| −1.2214 | 0.0019 | −0.2000 |
| −1.2730 | 0.0284 | −0.2000 |
| −1.3177 | 0.0535 | −0.2000 |
| −1.3556 | 0.0767 | −0.2000 |
| −1.3872 | 0.0976 | −0.2000 |
| −1.4137 | 0.1161 | −0.2000 |
| −1.4353 | 0.1324 | −0.2000 |
| −1.4520 | 0.1474 | −0.2000 |
| −1.4637 | 0.1612 | −0.2000 |
| −1.4708 | 0.1731 | −0.2000 |
| −1.4745 | 0.1829 | −0.2000 |
| −1.4760 | 0.1915 | −0.2000 |
| −1.4759 | 0.1985 | −0.2000 |
| −1.4749 | 0.2036 | −0.2000 |
| −1.4732 | 0.2082 | −0.2000 |
| −1.4699 | 0.2138 | −0.2000 |
| −1.4646 | 0.2199 | −0.2000 |
| −1.4568 | 0.2258 | −0.2000 |
| −1.4454 | 0.2316 | −0.2000 |
| −1.4293 | 0.2367 | −0.2000 |
| −1.4086 | 0.2402 | −0.2000 |
| −1.3831 | 0.2422 | −0.2000 |
| −1.3528 | 0.2435 | −0.2000 |
| −1.3172 | 0.2443 | −0.2000 |
| −1.2752 | 0.2443 | −0.2000 |
| −1.2267 | 0.2434 | −0.2000 |
| −1.1718 | 0.2413 | −0.2000 |
| −1.1104 | 0.2383 | −0.2000 |
| −1.0426 | 0.2342 | −0.2000 |
| −0.9684 | 0.2291 | −0.2000 |
| −0.8910 | 0.2235 | −0.2000 |
| −0.8104 | 0.2177 | −0.2000 |
| −0.7265 | 0.2116 | −0.2000 |
| −0.6394 | 0.2052 | −0.2000 |
| −0.5491 | 0.1986 | −0.2000 |
| −0.4556 | 0.1919 | −0.2000 |
| −0.3588 | 0.1852 | −0.2000 |
| −0.2621 | 0.1785 | −0.2000 |
| −0.1653 | 0.1720 | −0.2000 |
| −0.0685 | 0.1653 | −0.2000 |
| 0.0283 | 0.1586 | −0.2000 |
| 0.1250 | 0.1515 | −0.2000 |
| 0.2217 | 0.1438 | −0.2000 |
| 0.3184 | 0.1361 | −0.2000 |
| 0.4151 | 0.1285 | −0.2000 |
| 0.5119 | 0.1213 | −0.2000 |
| 0.6087 | 0.1148 | −0.2000 |
| 0.7055 | 0.1090 | −0.2000 |
| 0.7991 | 0.1044 | −0.2000 |
| 0.8896 | 0.1009 | −0.2000 |
| 0.9769 | 0.0985 | −0.2000 |
| 1.0609 | 0.0974 | −0.2000 |
| 1.1417 | 0.0975 | −0.2000 |
| 1.2192 | 0.0988 | −0.2000 |
| 1.2934 | 0.1014 | −0.2000 |
| 1.3644 | 0.1050 | −0.2000 |
| 1.4289 | 0.1093 | −0.2000 |
| 1.4869 | 0.1142 | −0.2000 |

TABLE A-continued

| X | Y | Z |
|---|---|---|
| 1.5384 | 0.1199 | −0.2000 |
| 1.5865 | 0.1268 | −0.2000 |
| 1.6280 | 0.1337 | −0.2000 |
| 1.6599 | 0.1394 | −0.2000 |
| 1.6853 | 0.1441 | −0.2000 |
| 1.7045 | 0.1453 | −0.2000 |
| 1.7174 | 0.1389 | −0.2000 |
| 1.7227 | 0.1329 | −0.2000 |
| 1.7252 | 0.1283 | −0.2000 |
| 1.7261 | 0.1259 | −0.2000 |
| 1.7265 | 0.1247 | −0.2000 |
| 1.7267 | 0.1241 | −0.2000 |
| 1.7138 | 0.1214 | 0.0000 |
| 1.7141 | 0.1201 | 0.0000 |
| 1.7145 | 0.1174 | 0.0000 |
| 1.7145 | 0.1121 | 0.0000 |
| 1.7126 | 0.1040 | 0.0000 |
| 1.7037 | 0.0920 | 0.0000 |
| 1.6853 | 0.0841 | 0.0000 |
| 1.6597 | 0.0756 | 0.0000 |
| 1.6276 | 0.0652 | 0.0000 |
| 1.5859 | 0.0517 | 0.0000 |
| 1.5380 | 0.0357 | 0.0000 |
| 1.4871 | 0.0179 | 0.0000 |
| 1.4299 | −0.0023 | 0.0000 |
| 1.3663 | −0.0245 | 0.0000 |
| 1.2960 | −0.0482 | 0.0000 |
| 1.2224 | −0.0724 | 0.0000 |
| 1.1453 | −0.0968 | 0.0000 |
| 1.0647 | −0.1212 | 0.0000 |
| 0.9804 | −0.1452 | 0.0000 |
| 0.8927 | −0.1685 | 0.0000 |
| 0.8014 | −0.1907 | 0.0000 |
| 0.7066 | −0.2116 | 0.0000 |
| 0.6081 | −0.2306 | 0.0000 |
| 0.5092 | −0.2470 | 0.0000 |
| 0.4098 | −0.2605 | 0.0000 |
| 0.3101 | −0.2710 | 0.0000 |
| 0.2098 | −0.2783 | 0.0000 |
| 0.1090 | −0.2819 | 0.0000 |
| 0.0076 | −0.2817 | 0.0000 |
| −0.0936 | −0.2777 | 0.0000 |
| −0.1941 | −0.2703 | 0.0000 |
| −0.2940 | −0.2595 | 0.0000 |
| −0.3933 | −0.2456 | 0.0000 |
| −0.4921 | −0.2287 | 0.0000 |
| −0.5870 | −0.2095 | 0.0000 |
| −0.6781 | −0.1883 | 0.0000 |
| −0.7655 | −0.1651 | 0.0000 |
| −0.8491 | −0.1403 | 0.0000 |
| −0.9291 | −0.1140 | 0.0000 |
| −1.0054 | −0.0864 | 0.0000 |
| −1.0777 | −0.0577 | 0.0000 |
| −1.1427 | −0.0294 | 0.0000 |
| −1.2006 | −0.0019 | 0.0000 |
| −1.2517 | 0.0241 | 0.0000 |
| −1.2959 | 0.0489 | 0.0000 |
| −1.3335 | 0.0718 | 0.0000 |
| −1.3647 | 0.0924 | 0.0000 |
| −1.3909 | 0.1108 | 0.0000 |
| −1.4122 | 0.1270 | 0.0000 |
| −1.4286 | 0.1418 | 0.0000 |
| −1.4401 | 0.1555 | 0.0000 |
| −1.4471 | 0.1674 | 0.0000 |
| −1.4507 | 0.1771 | 0.0000 |
| −1.4522 | 0.1856 | 0.0000 |
| −1.4520 | 0.1925 | 0.0000 |
| −1.4510 | 0.1976 | 0.0000 |
| −1.4493 | 0.2021 | 0.0000 |
| −1.4462 | 0.2077 | 0.0000 |
| −1.4409 | 0.2137 | 0.0000 |
| −1.4334 | 0.2196 | 0.0000 |
| −1.4221 | 0.2255 | 0.0000 |
| −1.4063 | 0.2307 | 0.0000 |
| −1.3858 | 0.2343 | 0.0000 |
| −1.3606 | 0.2364 | 0.0000 |
| −1.3306 | 0.2378 | 0.0000 |
| −1.2955 | 0.2387 | 0.0000 |

TABLE A-continued

| X | Y | Z |
|---|---|---|
| −1.2539 | 0.2388 | 0.0000 |
| −1.2060 | 0.2379 | 0.0000 |
| −1.1517 | 0.2358 | 0.0000 |
| −1.0910 | 0.2328 | 0.0000 |
| −1.0240 | 0.2288 | 0.0000 |
| −0.9507 | 0.2238 | 0.0000 |
| −0.8741 | 0.2185 | 0.0000 |
| −0.7944 | 0.2128 | 0.0000 |
| −0.7115 | 0.2068 | 0.0000 |
| −0.6255 | 0.2006 | 0.0000 |
| −0.5362 | 0.1942 | 0.0000 |
| −0.4437 | 0.1876 | 0.0000 |
| −0.3480 | 0.1810 | 0.0000 |
| −0.2524 | 0.1746 | 0.0000 |
| −0.1567 | 0.1682 | 0.0000 |
| −0.0610 | 0.1617 | 0.0000 |
| 0.0347 | 0.1551 | 0.0000 |
| 0.1303 | 0.1482 | 0.0000 |
| 0.2259 | 0.1407 | 0.0000 |
| 0.3215 | 0.1331 | 0.0000 |
| 0.4171 | 0.1256 | 0.0000 |
| 0.5127 | 0.1186 | 0.0000 |
| 0.6084 | 0.1122 | 0.0000 |
| 0.7041 | 0.1066 | 0.0000 |
| 0.7967 | 0.1020 | 0.0000 |
| 0.8861 | 0.0986 | 0.0000 |
| 0.9724 | 0.0963 | 0.0000 |
| 1.0555 | 0.0953 | 0.0000 |
| 1.1353 | 0.0954 | 0.0000 |
| 1.2119 | 0.0967 | 0.0000 |
| 1.2853 | 0.0993 | 0.0000 |
| 1.3555 | 0.1029 | 0.0000 |
| 1.4192 | 0.1071 | 0.0000 |
| 1.4765 | 0.1121 | 0.0000 |
| 1.5275 | 0.1177 | 0.0000 |
| 1.5750 | 0.1245 | 0.0000 |
| 1.6160 | 0.1314 | 0.0000 |
| 1.6475 | 0.1370 | 0.0000 |
| 1.6727 | 0.1416 | 0.0000 |
| 1.6917 | 0.1429 | 0.0000 |
| 1.7045 | 0.1367 | 0.0000 |
| 1.7097 | 0.1307 | 0.0000 |
| 1.7122 | 0.1263 | 0.0000 |
| 1.7131 | 0.1239 | 0.0000 |
| 1.7135 | 0.1227 | 0.0000 |
| 1.7137 | 0.1221 | 0.0000 |
| 1.6716 | 0.1149 | 0.6500 |
| 1.6719 | 0.1137 | 0.6500 |
| 1.6722 | 0.1111 | 0.6500 |
| 1.6722 | 0.1060 | 0.6500 |
| 1.6703 | 0.0982 | 0.6500 |
| 1.6614 | 0.0869 | 0.6500 |
| 1.6436 | 0.0794 | 0.6500 |
| 1.6189 | 0.0712 | 0.6500 |
| 1.5881 | 0.0611 | 0.6500 |
| 1.5479 | 0.0480 | 0.6500 |
| 1.5017 | 0.0326 | 0.6500 |
| 1.4527 | 0.0155 | 0.6500 |
| 1.3976 | −0.0041 | 0.6500 |
| 1.3363 | −0.0255 | 0.6500 |
| 1.2687 | −0.0484 | 0.6500 |
| 1.1978 | −0.0718 | 0.6500 |
| 1.1235 | −0.0954 | 0.6500 |
| 1.0459 | −0.1190 | 0.6500 |
| 0.9648 | −0.1422 | 0.6500 |
| 0.8803 | −0.1648 | 0.6500 |
| 0.7924 | −0.1864 | 0.6500 |
| 0.7011 | −0.2067 | 0.6500 |
| 0.6062 | −0.2252 | 0.6500 |
| 0.5110 | −0.2412 | 0.6500 |
| 0.4153 | −0.2545 | 0.6500 |
| 0.3191 | −0.2649 | 0.6500 |
| 0.2224 | −0.2721 | 0.6500 |
| 0.1252 | −0.2759 | 0.6500 |
| 0.0275 | −0.2759 | 0.6500 |
| −0.0699 | −0.2724 | 0.6500 |
| −0.1667 | −0.2655 | 0.6500 |
| −0.2629 | −0.2554 | 0.6500 |

TABLE A-continued

| X | Y | Z |
|---|---|---|
| −0.3586 | −0.2423 | 0.6500 |
| −0.4537 | −0.2263 | 0.6500 |
| −0.5452 | −0.2081 | 0.6500 |
| −0.6331 | −0.1879 | 0.6500 |
| −0.7173 | −0.1659 | 0.6500 |
| −0.7980 | −0.1422 | 0.6500 |
| −0.8752 | −0.1171 | 0.6500 |
| −0.9489 | −0.0907 | 0.6500 |
| −1.0186 | −0.0632 | 0.6500 |
| −1.0813 | −0.0362 | 0.6500 |
| −1.1373 | −0.0103 | 0.6500 |
| −1.1867 | 0.0144 | 0.6500 |
| −1.2293 | 0.0382 | 0.6500 |
| −1.2656 | 0.0603 | 0.6500 |
| −1.2957 | 0.0802 | 0.6500 |
| −1.3208 | 0.0980 | 0.6500 |
| −1.3413 | 0.1137 | 0.6500 |
| −1.3572 | 0.1279 | 0.6500 |
| −1.3683 | 0.1412 | 0.6500 |
| −1.3749 | 0.1526 | 0.6500 |
| −1.3784 | 0.1620 | 0.6500 |
| −1.3797 | 0.1702 | 0.6500 |
| −1.3795 | 0.1768 | 0.6500 |
| −1.3785 | 0.1817 | 0.6500 |
| −1.3769 | 0.1861 | 0.6500 |
| −1.3739 | 0.1915 | 0.6500 |
| −1.3689 | 0.1974 | 0.6500 |
| −1.3617 | 0.2032 | 0.6500 |
| −1.3510 | 0.2090 | 0.6500 |
| −1.3358 | 0.2141 | 0.6500 |
| −1.3160 | 0.2176 | 0.6500 |
| −1.2918 | 0.2198 | 0.6500 |
| −1.2629 | 0.2214 | 0.6500 |
| −1.2290 | 0.2226 | 0.6500 |
| −1.1890 | 0.2230 | 0.6500 |
| −1.1428 | 0.2224 | 0.6500 |
| −1.0905 | 0.2203 | 0.6500 |
| −1.0320 | 0.2171 | 0.6500 |
| −0.9674 | 0.2133 | 0.6500 |
| −0.8967 | 0.2089 | 0.6500 |
| −0.8230 | 0.2039 | 0.6500 |
| −0.7461 | 0.1986 | 0.6500 |
| −0.6662 | 0.1929 | 0.6500 |
| −0.5833 | 0.1871 | 0.6500 |
| −0.4972 | 0.1811 | 0.6500 |
| −0.4081 | 0.1750 | 0.6500 |
| −0.3159 | 0.1689 | 0.6500 |
| −0.2237 | 0.1629 | 0.6500 |
| −0.1314 | 0.1569 | 0.6500 |
| −0.0392 | 0.1509 | 0.6500 |
| 0.0530 | 0.1448 | 0.6500 |
| 0.1452 | 0.1382 | 0.6500 |
| 0.2373 | 0.1312 | 0.6500 |
| 0.3295 | 0.1240 | 0.6500 |
| 0.4216 | 0.1170 | 0.6500 |
| 0.5138 | 0.1104 | 0.6500 |
| 0.6060 | 0.1043 | 0.6500 |
| 0.6982 | 0.0990 | 0.6500 |
| 0.7875 | 0.0947 | 0.6500 |
| 0.8737 | 0.0915 | 0.6500 |
| 0.9568 | 0.0894 | 0.6500 |
| 1.0369 | 0.0885 | 0.6500 |
| 1.1138 | 0.0887 | 0.6500 |
| 1.1876 | 0.0900 | 0.6500 |
| 1.2584 | 0.0925 | 0.6500 |
| 1.3260 | 0.0961 | 0.6500 |
| 1.3874 | 0.1002 | 0.6500 |
| 1.4427 | 0.1050 | 0.6500 |
| 1.4917 | 0.1106 | 0.6500 |
| 1.5375 | 0.1172 | 0.6500 |
| 1.5770 | 0.1239 | 0.6500 |
| 1.6074 | 0.1293 | 0.6500 |
| 1.6317 | 0.1337 | 0.6500 |
| 1.6500 | 0.1353 | 0.6500 |
| 1.6624 | 0.1295 | 0.6500 |
| 1.6676 | 0.1239 | 0.6500 |
| 1.6700 | 0.1196 | 0.6500 |
| 1.6709 | 0.1173 | 0.6500 |

TABLE A-continued

| X | Y | Z |
|---|---|---|
| 1.6713 | 0.1162 | 0.6500 |
| 1.6714 | 0.1156 | 0.6500 |
| 1.6322 | 0.1094 | 1.3000 |
| 1.6325 | 0.1081 | 1.3000 |
| 1.6328 | 0.1056 | 1.3000 |
| 1.6328 | 0.1006 | 1.3000 |
| 1.6307 | 0.0930 | 1.3000 |
| 1.6216 | 0.0823 | 1.3000 |
| 1.6041 | 0.0754 | 1.3000 |
| 1.5802 | 0.0674 | 1.3000 |
| 1.5504 | 0.0576 | 1.3000 |
| 1.5115 | 0.0451 | 1.3000 |
| 1.4668 | 0.0302 | 1.3000 |
| 1.4193 | 0.0136 | 1.3000 |
| 1.3660 | −0.0052 | 1.3000 |
| 1.3066 | −0.0259 | 1.3000 |
| 1.2411 | −0.0481 | 1.3000 |
| 1.1724 | −0.0706 | 1.3000 |
| 1.1005 | −0.0934 | 1.3000 |
| 1.0253 | −0.1161 | 1.3000 |
| 0.9468 | −0.1385 | 1.3000 |
| 0.8649 | −0.1602 | 1.3000 |
| 0.7797 | −0.1809 | 1.3000 |
| 0.6912 | −0.2004 | 1.3000 |
| 0.5993 | −0.2182 | 1.3000 |
| 0.5071 | −0.2334 | 1.3000 |
| 0.4145 | −0.2461 | 1.3000 |
| 0.3216 | −0.2559 | 1.3000 |
| 0.2282 | −0.2627 | 1.3000 |
| 0.1343 | −0.2661 | 1.3000 |
| 0.0399 | −0.2659 | 1.3000 |
| −0.0546 | −0.2623 | 1.3000 |
| −0.1485 | −0.2555 | 1.3000 |
| −0.2418 | −0.2456 | 1.3000 |
| −0.3345 | −0.2327 | 1.3000 |
| −0.4266 | −0.2171 | 1.3000 |
| −0.5152 | −0.1993 | 1.3000 |
| −0.6002 | −0.1796 | 1.3000 |
| −0.6817 | −0.1581 | 1.3000 |
| −0.7597 | −0.1351 | 1.3000 |
| −0.8342 | −0.1107 | 1.3000 |
| −0.9054 | −0.0850 | 1.3000 |
| −0.9729 | −0.0582 | 1.3000 |
| −1.0336 | −0.0320 | 1.3000 |
| −1.0879 | −0.0069 | 1.3000 |
| −1.1357 | 0.0172 | 1.3000 |
| −1.1770 | 0.0403 | 1.3000 |
| −1.2119 | 0.0619 | 1.3000 |
| −1.2410 | 0.0812 | 1.3000 |
| −1.2653 | 0.0985 | 1.3000 |
| −1.2853 | 0.1136 | 1.3000 |
| −1.3011 | 0.1269 | 1.3000 |
| −1.3124 | 0.1391 | 1.3000 |
| −1.3194 | 0.1499 | 1.3000 |
| −1.3232 | 0.1588 | 1.3000 |
| −1.3248 | 0.1667 | 1.3000 |
| −1.3247 | 0.1731 | 1.3000 |
| −1.3238 | 0.1779 | 1.3000 |
| −1.3222 | 0.1821 | 1.3000 |
| −1.3191 | 0.1872 | 1.3000 |
| −1.3140 | 0.1927 | 1.3000 |
| −1.3067 | 0.1979 | 1.3000 |
| −1.2959 | 0.2030 | 1.3000 |
| −1.2810 | 0.2071 | 1.3000 |
| −1.2618 | 0.2098 | 1.3000 |
| −1.2383 | 0.2115 | 1.3000 |
| −1.2103 | 0.2131 | 1.3000 |
| −1.1775 | 0.2144 | 1.3000 |
| −1.1387 | 0.2149 | 1.3000 |
| −1.0940 | 0.2144 | 1.3000 |
| −1.0433 | 0.2124 | 1.3000 |
| −0.9867 | 0.2093 | 1.3000 |
| −0.9241 | 0.2056 | 1.3000 |
| −0.8556 | 0.2014 | 1.3000 |
| −0.7842 | 0.1966 | 1.3000 |
| −0.7098 | 0.1914 | 1.3000 |
| −0.6324 | 0.1860 | 1.3000 |
| −0.5520 | 0.1804 | 1.3000 |

TABLE A-continued

| X | Y | Z |
|---|---|---|
| −0.4687 | 0.1746 | 1.3000 |
| −0.3823 | 0.1687 | 1.3000 |
| −0.2930 | 0.1626 | 1.3000 |
| −0.2037 | 0.1568 | 1.3000 |
| −0.1144 | 0.1509 | 1.3000 |
| −0.0251 | 0.1450 | 1.3000 |
| 0.0642 | 0.1390 | 1.3000 |
| 0.1535 | 0.1326 | 1.3000 |
| 0.2428 | 0.1257 | 1.3000 |
| 0.3320 | 0.1187 | 1.3000 |
| 0.4213 | 0.1118 | 1.3000 |
| 0.5105 | 0.1053 | 1.3000 |
| 0.5998 | 0.0994 | 1.3000 |
| 0.6892 | 0.0941 | 1.3000 |
| 0.7756 | 0.0899 | 1.3000 |
| 0.8590 | 0.0867 | 1.3000 |
| 0.9396 | 0.0846 | 1.3000 |
| 1.0171 | 0.0836 | 1.3000 |
| 1.0917 | 0.0837 | 1.3000 |
| 1.1632 | 0.0849 | 1.3000 |
| 1.2317 | 0.0873 | 1.3000 |
| 1.2972 | 0.0906 | 1.3000 |
| 1.3567 | 0.0946 | 1.3000 |
| 1.4102 | 0.0992 | 1.3000 |
| 1.4577 | 0.1045 | 1.3000 |
| 1.5020 | 0.1109 | 1.3000 |
| 1.5403 | 0.1174 | 1.3000 |
| 1.5698 | 0.1226 | 1.3000 |
| 1.5933 | 0.1268 | 1.3000 |
| 1.6110 | 0.1287 | 1.3000 |
| 1.6232 | 0.1234 | 1.3000 |
| 1.6283 | 0.1181 | 1.3000 |
| 1.6307 | 0.1139 | 1.3000 |
| 1.6315 | 0.1117 | 1.3000 |
| 1.6319 | 0.1106 | 1.3000 |
| 1.6321 | 0.1100 | 1.3000 |
| 1.6067 | 0.1040 | 1.9500 |
| 1.6070 | 0.1027 | 1.9500 |
| 1.6073 | 0.1002 | 1.9500 |
| 1.6071 | 0.0952 | 1.9500 |
| 1.6048 | 0.0877 | 1.9500 |
| 1.5952 | 0.0777 | 1.9500 |
| 1.5779 | 0.0713 | 1.9500 |
| 1.5546 | 0.0635 | 1.9500 |
| 1.5252 | 0.0541 | 1.9500 |
| 1.4871 | 0.0420 | 1.9500 |
| 1.4432 | 0.0276 | 1.9500 |
| 1.3966 | 0.0116 | 1.9500 |
| 1.3443 | −0.0067 | 1.9500 |
| 1.2860 | −0.0266 | 1.9500 |
| 1.2217 | −0.0479 | 1.9500 |
| 1.1543 | −0.0696 | 1.9500 |
| 1.0837 | −0.0915 | 1.9500 |
| 1.0099 | −0.1132 | 1.9500 |
| 0.9327 | −0.1345 | 1.9500 |
| 0.8522 | −0.1552 | 1.9500 |
| 0.7684 | −0.1749 | 1.9500 |
| 0.6814 | −0.1933 | 1.9500 |
| 0.5912 | −0.2100 | 1.9500 |
| 0.5007 | −0.2242 | 1.9500 |
| 0.4099 | −0.2358 | 1.9500 |
| 0.3189 | −0.2446 | 1.9500 |
| 0.2276 | −0.2505 | 1.9500 |
| 0.1360 | −0.2531 | 1.9500 |
| 0.0440 | −0.2523 | 1.9500 |
| −0.0483 | −0.2482 | 1.9500 |
| −0.1406 | −0.2410 | 1.9500 |
| −0.2323 | −0.2307 | 1.9500 |
| −0.3233 | −0.2176 | 1.9500 |
| −0.4136 | −0.2018 | 1.9500 |
| −0.5004 | −0.1840 | 1.9500 |
| −0.5836 | −0.1644 | 1.9500 |
| −0.6633 | −0.1431 | 1.9500 |
| −0.7395 | −0.1204 | 1.9500 |
| −0.8123 | −0.0964 | 1.9500 |
| −0.8817 | −0.0712 | 1.9500 |
| −0.9477 | −0.0448 | 1.9500 |
| −1.0073 | −0.0190 | 1.9500 |

TABLE A-continued

| X | Y | Z |
|---|---|---|
| −1.0606 | 0.0056 | 1.9500 |
| −1.1075 | 0.0292 | 1.9500 |
| −1.1479 | 0.0518 | 1.9500 |
| −1.1822 | 0.0728 | 1.9500 |
| −1.2106 | 0.0917 | 1.9500 |
| −1.2345 | 0.1086 | 1.9500 |
| −1.2541 | 0.1233 | 1.9500 |
| −1.2699 | 0.1359 | 1.9500 |
| −1.2815 | 0.1473 | 1.9500 |
| −1.2889 | 0.1575 | 1.9500 |
| −1.2930 | 0.1660 | 1.9500 |
| −1.2949 | 0.1736 | 1.9500 |
| −1.2950 | 0.1799 | 1.9500 |
| −1.2941 | 0.1846 | 1.9500 |
| −1.2924 | 0.1887 | 1.9500 |
| −1.2892 | 0.1936 | 1.9500 |
| −1.2839 | 0.1987 | 1.9500 |
| −1.2765 | 0.2034 | 1.9500 |
| −1.2656 | 0.2076 | 1.9500 |
| −1.2507 | 0.2108 | 1.9500 |
| −1.2318 | 0.2127 | 1.9500 |
| −1.2087 | 0.2142 | 1.9500 |
| −1.1813 | 0.2155 | 1.9500 |
| −1.1491 | 0.2165 | 1.9500 |
| −1.1110 | 0.2167 | 1.9500 |
| −1.0672 | 0.2159 | 1.9500 |
| −1.0175 | 0.2136 | 1.9500 |
| −0.9620 | 0.2102 | 1.9500 |
| −0.9006 | 0.2063 | 1.9500 |
| −0.8335 | 0.2018 | 1.9500 |
| −0.7634 | 0.1968 | 1.9500 |
| −0.6904 | 0.1914 | 1.9500 |
| −0.6145 | 0.1857 | 1.9500 |
| −0.5357 | 0.1799 | 1.9500 |
| −0.4540 | 0.1738 | 1.9500 |
| −0.3694 | 0.1676 | 1.9500 |
| −0.2818 | 0.1613 | 1.9500 |
| −0.1942 | 0.1552 | 1.9500 |
| −0.1066 | 0.1491 | 1.9500 |
| −0.0191 | 0.1429 | 1.9500 |
| 0.0685 | 0.1367 | 1.9500 |
| 0.1561 | 0.1301 | 1.9500 |
| 0.2436 | 0.1231 | 1.9500 |
| 0.3311 | 0.1160 | 1.9500 |
| 0.4186 | 0.1091 | 1.9500 |
| 0.5062 | 0.1025 | 1.9500 |
| 0.5937 | 0.0964 | 1.9500 |
| 0.6814 | 0.0910 | 1.9500 |
| 0.7661 | 0.0866 | 1.9500 |
| 0.8480 | 0.0833 | 1.9500 |
| 0.9269 | 0.0810 | 1.9500 |
| 1.0030 | 0.0798 | 1.9500 |
| 1.0761 | 0.0797 | 1.9500 |
| 1.1463 | 0.0807 | 1.9500 |
| 1.2135 | 0.0828 | 1.9500 |
| 1.2777 | 0.0859 | 1.9500 |
| 1.3361 | 0.0895 | 1.9500 |
| 1.3886 | 0.0938 | 1.9500 |
| 1.4352 | 0.0988 | 1.9500 |
| 1.4787 | 0.1050 | 1.9500 |
| 1.5163 | 0.1112 | 1.9500 |
| 1.5452 | 0.1162 | 1.9500 |
| 1.5683 | 0.1203 | 1.9500 |
| 1.5857 | 0.1224 | 1.9500 |
| 1.5978 | 0.1177 | 1.9500 |
| 1.6029 | 0.1125 | 1.9500 |
| 1.6052 | 0.1084 | 1.9500 |
| 1.6060 | 0.1063 | 1.9500 |
| 1.6064 | 0.1051 | 1.9500 |
| 1.6066 | 0.1046 | 1.9500 |
| 1.6056 | 0.0959 | 2.6000 |
| 1.6058 | 0.0947 | 2.6000 |
| 1.6061 | 0.0923 | 2.6000 |
| 1.6059 | 0.0875 | 2.6000 |
| 1.6035 | 0.0803 | 2.6000 |
| 1.5939 | 0.0707 | 2.6000 |
| 1.5766 | 0.0647 | 2.6000 |
| 1.5533 | 0.0572 | 2.6000 |

TABLE A-continued

| X | Y | Z |
|---|---|---|
| 1.5240 | 0.0482 | 2.6000 |
| 1.4859 | 0.0367 | 2.6000 |
| 1.4421 | 0.0229 | 2.6000 |
| 1.3956 | 0.0076 | 2.6000 |
| 1.3433 | −0.0099 | 2.6000 |
| 1.2852 | −0.0290 | 2.6000 |
| 1.2209 | −0.0492 | 2.6000 |
| 1.1536 | −0.0698 | 2.6000 |
| 1.0831 | −0.0906 | 2.6000 |
| 1.0094 | −0.1112 | 2.6000 |
| 0.9325 | −0.1313 | 2.6000 |
| 0.8522 | −0.1508 | 2.6000 |
| 0.7685 | −0.1692 | 2.6000 |
| 0.6815 | −0.1864 | 2.6000 |
| 0.5915 | −0.2018 | 2.6000 |
| 0.5012 | −0.2147 | 2.6000 |
| 0.4108 | −0.2252 | 2.6000 |
| 0.3202 | −0.2329 | 2.6000 |
| 0.2294 | −0.2377 | 2.6000 |
| 0.1384 | −0.2394 | 2.6000 |
| 0.0472 | −0.2378 | 2.6000 |
| −0.0443 | −0.2330 | 2.6000 |
| −0.1359 | −0.2251 | 2.6000 |
| −0.2271 | −0.2143 | 2.6000 |
| −0.3176 | −0.2008 | 2.6000 |
| −0.4075 | −0.1847 | 2.6000 |
| −0.4937 | −0.1666 | 2.6000 |
| −0.5763 | −0.1468 | 2.6000 |
| −0.6554 | −0.1254 | 2.6000 |
| −0.7311 | −0.1027 | 2.6000 |
| −0.8033 | −0.0788 | 2.6000 |
| −0.8721 | −0.0538 | 2.6000 |
| −0.9374 | −0.0277 | 2.6000 |
| −0.9967 | −0.0022 | 2.6000 |
| −1.0498 | 0.0221 | 2.6000 |
| −1.0964 | 0.0455 | 2.6000 |
| −1.1366 | 0.0678 | 2.6000 |
| −1.1707 | 0.0884 | 2.6000 |
| −1.1990 | 0.1069 | 2.6000 |
| −1.2228 | 0.1235 | 2.6000 |
| −1.2424 | 0.1379 | 2.6000 |
| −1.2582 | 0.1502 | 2.6000 |
| −1.2699 | 0.1611 | 2.6000 |
| −1.2777 | 0.1709 | 2.6000 |
| −1.2821 | 0.1791 | 2.6000 |
| −1.2841 | 0.1867 | 2.6000 |
| −1.2844 | 0.1929 | 2.6000 |
| −1.2835 | 0.1975 | 2.6000 |
| −1.2817 | 0.2017 | 2.6000 |
| −1.2784 | 0.2064 | 2.6000 |
| −1.2728 | 0.2113 | 2.6000 |
| −1.2651 | 0.2156 | 2.6000 |
| −1.2542 | 0.2192 | 2.6000 |
| −1.2393 | 0.2217 | 2.6000 |
| −1.2205 | 0.2232 | 2.6000 |
| −1.1975 | 0.2243 | 2.6000 |
| −1.1701 | 0.2252 | 2.6000 |
| −1.1380 | 0.2257 | 2.6000 |
| −1.1001 | 0.2254 | 2.6000 |
| −1.0564 | 0.2240 | 2.6000 |
| −1.0070 | 0.2212 | 2.6000 |
| −0.9518 | 0.2172 | 2.6000 |
| −0.8907 | 0.2126 | 2.6000 |
| −0.8239 | 0.2075 | 2.6000 |
| −0.7542 | 0.2018 | 2.6000 |
| −0.6816 | 0.1958 | 2.6000 |
| −0.6061 | 0.1894 | 2.6000 |
| −0.5277 | 0.1829 | 2.6000 |
| −0.4463 | 0.1762 | 2.6000 |
| −0.3621 | 0.1693 | 2.6000 |
| −0.2750 | 0.1624 | 2.6000 |
| −0.1878 | 0.1556 | 2.6000 |
| −0.1006 | 0.1489 | 2.6000 |
| −0.0135 | 0.1421 | 2.6000 |
| 0.0737 | 0.1353 | 2.6000 |
| 0.1609 | 0.1283 | 2.6000 |
| 0.2480 | 0.1209 | 2.6000 |
| 0.3351 | 0.1134 | 2.6000 |

TABLE A-continued

| X | Y | Z |
|---|---|---|
| 0.4222 | 0.1061 | 2.6000 |
| 0.5093 | 0.0992 | 2.6000 |
| 0.5965 | 0.0928 | 2.6000 |
| 0.6837 | 0.0871 | 2.6000 |
| 0.7681 | 0.0824 | 2.6000 |
| 0.8496 | 0.0787 | 2.6000 |
| 0.9282 | 0.0761 | 2.6000 |
| 1.0040 | 0.0746 | 2.6000 |
| 1.0768 | 0.0741 | 2.6000 |
| 1.1467 | 0.0748 | 2.6000 |
| 1.2136 | 0.0765 | 2.6000 |
| 1.2776 | 0.0793 | 2.6000 |
| 1.3357 | 0.0826 | 2.6000 |
| 1.3880 | 0.0865 | 2.6000 |
| 1.4344 | 0.0911 | 2.6000 |
| 1.4778 | 0.0969 | 2.6000 |
| 1.5153 | 0.1029 | 2.6000 |
| 1.5441 | 0.1077 | 2.6000 |
| 1.5671 | 0.1115 | 2.6000 |
| 1.5845 | 0.1138 | 2.6000 |
| 1.5967 | 0.1095 | 2.6000 |
| 1.6018 | 0.1044 | 2.6000 |
| 1.6041 | 0.1004 | 2.6000 |
| 1.6050 | 0.0982 | 2.6000 |
| 1.6053 | 0.0971 | 2.6000 |
| 1.6054 | 0.0965 | 2.6000 |
| 1.6193 | 0.0862 | 3.2500 |
| 1.6195 | 0.0850 | 3.2500 |
| 1.6197 | 0.0825 | 3.2500 |
| 1.6193 | 0.0776 | 3.2500 |
| 1.6166 | 0.0704 | 3.2500 |
| 1.6063 | 0.0615 | 3.2500 |
| 1.5888 | 0.0559 | 3.2500 |
| 1.5653 | 0.0487 | 3.2500 |
| 1.5359 | 0.0402 | 3.2500 |
| 1.4976 | 0.0293 | 3.2500 |
| 1.4535 | 0.0163 | 3.2500 |
| 1.4067 | 0.0017 | 3.2500 |
| 1.3541 | −0.0149 | 3.2500 |
| 1.2955 | −0.0330 | 3.2500 |
| 1.2309 | −0.0521 | 3.2500 |
| 1.1631 | −0.0716 | 3.2500 |
| 1.0922 | −0.0911 | 3.2500 |
| 1.0181 | −0.1105 | 3.2500 |
| 0.9407 | −0.1294 | 3.2500 |
| 0.8601 | −0.1476 | 3.2500 |
| 0.7760 | −0.1648 | 3.2500 |
| 0.6886 | −0.1807 | 3.2500 |
| 0.5980 | −0.1948 | 3.2500 |
| 0.5073 | −0.2066 | 3.2500 |
| 0.4166 | −0.2159 | 3.2500 |
| 0.3257 | −0.2226 | 3.2500 |
| 0.2347 | −0.2264 | 3.2500 |
| 0.1437 | −0.2272 | 3.2500 |
| 0.0525 | −0.2248 | 3.2500 |
| −0.0387 | −0.2193 | 3.2500 |
| −0.1301 | −0.2108 | 3.2500 |
| −0.2215 | −0.1995 | 3.2500 |
| −0.3122 | −0.1854 | 3.2500 |
| −0.4021 | −0.1688 | 3.2500 |
| −0.4885 | −0.1504 | 3.2500 |
| −0.5712 | −0.1303 | 3.2500 |
| −0.6503 | −0.1087 | 3.2500 |
| −0.7259 | −0.0858 | 3.2500 |
| −0.7981 | −0.0618 | 3.2500 |
| −0.8668 | −0.0368 | 3.2500 |
| −0.9321 | −0.0107 | 3.2500 |
| −0.9912 | 0.0148 | 3.2500 |
| −1.0444 | 0.0390 | 3.2500 |
| −1.0911 | 0.0625 | 3.2500 |
| −1.1314 | 0.0846 | 3.2500 |
| −1.1656 | 0.1051 | 3.2500 |
| −1.1940 | 0.1234 | 3.2500 |
| −1.2178 | 0.1398 | 3.2500 |
| −1.2375 | 0.1542 | 3.2500 |
| −1.2534 | 0.1663 | 3.2500 |
| −1.2655 | 0.1768 | 3.2500 |
| −1.2737 | 0.1861 | 3.2500 |

TABLE A-continued

| X | Y | Z |
|---|---|---|
| −1.2785 | 0.1942 | 3.2500 |
| −1.2809 | 0.2016 | 3.2500 |
| −1.2813 | 0.2078 | 3.2500 |
| −1.2804 | 0.2124 | 3.2500 |
| −1.2787 | 0.2165 | 3.2500 |
| −1.2751 | 0.2211 | 3.2500 |
| −1.2694 | 0.2257 | 3.2500 |
| −1.2615 | 0.2295 | 3.2500 |
| −1.2502 | 0.2326 | 3.2500 |
| −1.2351 | 0.2344 | 3.2500 |
| −1.2161 | 0.2354 | 3.2500 |
| −1.1931 | 0.2362 | 3.2500 |
| −1.1656 | 0.2367 | 3.2500 |
| −1.1334 | 0.2367 | 3.2500 |
| −1.0954 | 0.2359 | 3.2500 |
| −1.0516 | 0.2340 | 3.2500 |
| −1.0020 | 0.2307 | 3.2500 |
| −0.9466 | 0.2261 | 3.2500 |
| −0.8854 | 0.2209 | 3.2500 |
| −0.8184 | 0.2151 | 3.2500 |
| −0.7485 | 0.2088 | 3.2500 |
| −0.6757 | 0.2020 | 3.2500 |
| −0.5999 | 0.1950 | 3.2500 |
| −0.5213 | 0.1877 | 3.2500 |
| −0.4398 | 0.1803 | 3.2500 |
| −0.3553 | 0.1726 | 3.2500 |
| −0.2679 | 0.1649 | 3.2500 |
| −0.1805 | 0.1574 | 3.2500 |
| −0.0931 | 0.1499 | 3.2500 |
| −0.0056 | 0.1425 | 3.2500 |
| 0.0818 | 0.1350 | 3.2500 |
| 0.1692 | 0.1273 | 3.2500 |
| 0.2566 | 0.1193 | 3.2500 |
| 0.3439 | 0.1113 | 3.2500 |
| 0.4313 | 0.1034 | 3.2500 |
| 0.5187 | 0.0960 | 3.2500 |
| 0.6062 | 0.0891 | 3.2500 |
| 0.6937 | 0.0830 | 3.2500 |
| 0.7783 | 0.0778 | 3.2500 |
| 0.8601 | 0.0737 | 3.2500 |
| 0.9390 | 0.0707 | 3.2500 |
| 1.0150 | 0.0687 | 3.2500 |
| 1.0881 | 0.0678 | 3.2500 |
| 1.1583 | 0.0680 | 3.2500 |
| 1.2254 | 0.0694 | 3.2500 |
| 1.2897 | 0.0717 | 3.2500 |
| 1.3480 | 0.0746 | 3.2500 |
| 1.4005 | 0.0780 | 3.2500 |
| 1.4472 | 0.0823 | 3.2500 |
| 1.4908 | 0.0877 | 3.2500 |
| 1.5284 | 0.0934 | 3.2500 |
| 1.5574 | 0.0979 | 3.2500 |
| 1.5805 | 0.1014 | 3.2500 |
| 1.5980 | 0.1038 | 3.2500 |
| 1.6103 | 0.0999 | 3.2500 |
| 1.6155 | 0.0948 | 3.2500 |
| 1.6178 | 0.0907 | 3.2500 |
| 1.6187 | 0.0885 | 3.2500 |
| 1.6190 | 0.0874 | 3.2500 |
| 1.6191 | 0.0868 | 3.2500 |
| 1.6368 | 0.0755 | 3.9000 |
| 1.6370 | 0.0743 | 3.9000 |
| 1.6372 | 0.0718 | 3.9000 |
| 1.6366 | 0.0668 | 3.9000 |
| 1.6336 | 0.0597 | 3.9000 |
| 1.6227 | 0.0513 | 3.9000 |
| 1.6051 | 0.0460 | 3.9000 |
| 1.5815 | 0.0392 | 3.9000 |
| 1.5519 | 0.0311 | 3.9000 |
| 1.5133 | 0.0209 | 3.9000 |
| 1.4689 | 0.0086 | 3.9000 |
| 1.4217 | −0.0052 | 3.9000 |
| 1.3687 | −0.0210 | 3.9000 |
| 1.3098 | −0.0381 | 3.9000 |
| 1.2447 | −0.0562 | 3.9000 |
| 1.1765 | −0.0745 | 3.9000 |
| 1.1051 | −0.0929 | 3.9000 |
| 1.0305 | −0.1111 | 3.9000 |

TABLE A-continued

| X | Y | Z |
|---|---|---|
| 0.9527 | −0.1289 | 3.9000 |
| 0.8715 | −0.1459 | 3.9000 |
| 0.7871 | −0.1618 | 3.9000 |
| 0.6993 | −0.1765 | 3.9000 |
| 0.6082 | −0.1896 | 3.9000 |
| 0.5167 | −0.2003 | 3.9000 |
| 0.4253 | −0.2086 | 3.9000 |
| 0.3339 | −0.2142 | 3.9000 |
| 0.2425 | −0.2172 | 3.9000 |
| 0.1512 | −0.2171 | 3.9000 |
| 0.0600 | −0.2139 | 3.9000 |
| −0.0313 | −0.2078 | 3.9000 |
| −0.1224 | −0.1988 | 3.9000 |
| −0.2136 | −0.1869 | 3.9000 |
| −0.3045 | −0.1723 | 3.9000 |
| −0.3948 | −0.1552 | 3.9000 |
| −0.4814 | −0.1364 | 3.9000 |
| −0.5643 | −0.1159 | 3.9000 |
| −0.6435 | −0.0940 | 3.9000 |
| −0.7192 | −0.0708 | 3.9000 |
| −0.7915 | −0.0466 | 3.9000 |
| −0.8602 | −0.0215 | 3.9000 |
| −0.9255 | 0.0047 | 3.9000 |
| −0.9846 | 0.0302 | 3.9000 |
| −1.0377 | 0.0545 | 3.9000 |
| −1.0845 | 0.0781 | 3.9000 |
| −1.1250 | 0.1003 | 3.9000 |
| −1.1594 | 0.1206 | 3.9000 |
| −1.1879 | 0.1389 | 3.9000 |
| −1.2118 | 0.1553 | 3.9000 |
| −1.2315 | 0.1696 | 3.9000 |
| −1.2475 | 0.1818 | 3.9000 |
| −1.2599 | 0.1919 | 3.9000 |
| −1.2685 | 0.2009 | 3.9000 |
| −1.2737 | 0.2086 | 3.9000 |
| −1.2766 | 0.2159 | 3.9000 |
| −1.2773 | 0.2222 | 3.9000 |
| −1.2764 | 0.2268 | 3.9000 |
| −1.2746 | 0.2308 | 3.9000 |
| −1.2707 | 0.2353 | 3.9000 |
| −1.2647 | 0.2394 | 3.9000 |
| −1.2565 | 0.2427 | 3.9000 |
| −1.2450 | 0.2451 | 3.9000 |
| −1.2298 | 0.2463 | 3.9000 |
| −1.2107 | 0.2470 | 3.9000 |
| −1.1875 | 0.2476 | 3.9000 |
| −1.1599 | 0.2478 | 3.9000 |
| −1.1276 | 0.2474 | 3.9000 |
| −1.0894 | 0.2461 | 3.9000 |
| −1.0454 | 0.2436 | 3.9000 |
| −0.9956 | 0.2399 | 3.9000 |
| −0.9400 | 0.2349 | 3.9000 |
| −0.8786 | 0.2291 | 3.9000 |
| −0.8113 | 0.2227 | 3.9000 |
| −0.7411 | 0.2158 | 3.9000 |
| −0.6681 | 0.2084 | 3.9000 |
| −0.5921 | 0.2007 | 3.9000 |
| −0.5131 | 0.1928 | 3.9000 |
| −0.4313 | 0.1847 | 3.9000 |
| −0.3465 | 0.1763 | 3.9000 |
| −0.2587 | 0.1679 | 3.9000 |
| −0.1710 | 0.1596 | 3.9000 |
| −0.0832 | 0.1514 | 3.9000 |
| 0.0045 | 0.1432 | 3.9000 |
| 0.0923 | 0.1350 | 3.9000 |
| 0.1800 | 0.1267 | 3.9000 |
| 0.2678 | 0.1180 | 3.9000 |
| 0.3555 | 0.1093 | 3.9000 |
| 0.4432 | 0.1009 | 3.9000 |
| 0.5310 | 0.0929 | 3.9000 |
| 0.6188 | 0.0855 | 3.9000 |
| 0.7067 | 0.0788 | 3.9000 |
| 0.7917 | 0.0731 | 3.9000 |
| 0.8738 | 0.0685 | 3.9000 |
| 0.9530 | 0.0649 | 3.9000 |
| 1.0294 | 0.0625 | 3.9000 |
| 1.1028 | 0.0611 | 3.9000 |
| 1.1733 | 0.0609 | 3.9000 |

TABLE A-continued

| X | Y | Z |
|---|---|---|
| 1.2408 | 0.0617 | 3.9000 |
| 1.3053 | 0.0636 | 3.9000 |
| 1.3640 | 0.0660 | 3.9000 |
| 1.4167 | 0.0690 | 3.9000 |
| 1.4636 | 0.0728 | 3.9000 |
| 1.5075 | 0.0779 | 3.9000 |
| 1.5454 | 0.0832 | 3.9000 |
| 1.5745 | 0.0874 | 3.9000 |
| 1.5978 | 0.0906 | 3.9000 |
| 1.6153 | 0.0929 | 3.9000 |
| 1.6278 | 0.0892 | 3.9000 |
| 1.6331 | 0.0841 | 3.9000 |
| 1.6354 | 0.0800 | 3.9000 |
| 1.6362 | 0.0778 | 3.9000 |
| 1.6365 | 0.0767 | 3.9000 |
| 1.6367 | 0.0761 | 3.9000 |
| 1.6482 | 0.0633 | 4.5500 |
| 1.6483 | 0.0621 | 4.5500 |
| 1.6485 | 0.0596 | 4.5500 |
| 1.6479 | 0.0547 | 4.5500 |
| 1.6448 | 0.0477 | 4.5500 |
| 1.6338 | 0.0397 | 4.5500 |
| 1.6161 | 0.0346 | 4.5500 |
| 1.5925 | 0.0282 | 4.5500 |
| 1.5628 | 0.0205 | 4.5500 |
| 1.5241 | 0.0110 | 4.5500 |
| 1.4796 | −0.0006 | 4.5500 |
| 1.4323 | −0.0135 | 4.5500 |
| 1.3791 | −0.0284 | 4.5500 |
| 1.3199 | −0.0445 | 4.5500 |
| 1.2547 | −0.0615 | 4.5500 |
| 1.1863 | −0.0787 | 4.5500 |
| 1.1148 | −0.0960 | 4.5500 |
| 1.0400 | −0.1130 | 4.5500 |
| 0.9621 | −0.1295 | 4.5500 |
| 0.8809 | −0.1453 | 4.5500 |
| 0.7963 | −0.1601 | 4.5500 |
| 0.7086 | −0.1736 | 4.5500 |
| 0.6178 | −0.1855 | 4.5500 |
| 0.5270 | −0.1951 | 4.5500 |
| 0.4362 | −0.2023 | 4.5500 |
| 0.3453 | −0.2071 | 4.5500 |
| 0.2544 | −0.2092 | 4.5500 |
| 0.1635 | −0.2085 | 4.5500 |
| 0.0725 | −0.2047 | 4.5500 |
| −0.0185 | −0.1980 | 4.5500 |
| −0.1095 | −0.1885 | 4.5500 |
| −0.2006 | −0.1762 | 4.5500 |
| −0.2916 | −0.1612 | 4.5500 |
| −0.3818 | −0.1438 | 4.5500 |
| −0.4683 | −0.1246 | 4.5500 |
| −0.5511 | −0.1038 | 4.5500 |
| −0.6304 | −0.0817 | 4.5500 |
| −0.7061 | −0.0584 | 4.5500 |
| −0.7783 | −0.0340 | 4.5500 |
| −0.8470 | −0.0088 | 4.5500 |
| −0.9123 | 0.0175 | 4.5500 |
| −0.9714 | 0.0430 | 4.5500 |
| −1.0245 | 0.0674 | 4.5500 |
| −1.0713 | 0.0910 | 4.5500 |
| −1.1119 | 0.1131 | 4.5500 |
| −1.1464 | 0.1333 | 4.5500 |
| −1.1750 | 0.1514 | 4.5500 |
| −1.1989 | 0.1678 | 4.5500 |
| −1.2187 | 0.1821 | 4.5500 |
| −1.2346 | 0.1944 | 4.5500 |
| −1.2470 | 0.2046 | 4.5500 |
| −1.2558 | 0.2133 | 4.5500 |
| −1.2613 | 0.2209 | 4.5500 |
| −1.2645 | 0.2281 | 4.5500 |
| −1.2653 | 0.2343 | 4.5500 |
| −1.2646 | 0.2389 | 4.5500 |
| −1.2626 | 0.2429 | 4.5500 |
| −1.2587 | 0.2472 | 4.5500 |
| −1.2524 | 0.2511 | 4.5500 |
| −1.2441 | 0.2540 | 4.5500 |
| −1.2326 | 0.2559 | 4.5500 |
| −1.2173 | 0.2569 | 4.5500 |

TABLE A-continued

| X | Y | Z |
|---|---|---|
| −1.1982 | 0.2577 | 4.5500 |
| −1.1750 | 0.2581 | 4.5500 |
| −1.1474 | 0.2580 | 4.5500 |
| −1.1151 | 0.2571 | 4.5500 |
| −1.0769 | 0.2552 | 4.5500 |
| −1.0330 | 0.2522 | 4.5500 |
| −0.9832 | 0.2480 | 4.5500 |
| −0.9276 | 0.2425 | 4.5500 |
| −0.8663 | 0.2362 | 4.5500 |
| −0.7990 | 0.2292 | 4.5500 |
| −0.7289 | 0.2216 | 4.5500 |
| −0.6559 | 0.2137 | 4.5500 |
| −0.5800 | 0.2054 | 4.5500 |
| −0.5011 | 0.1968 | 4.5500 |
| −0.4193 | 0.1880 | 4.5500 |
| −0.3346 | 0.1790 | 4.5500 |
| −0.2469 | 0.1699 | 4.5500 |
| −0.1592 | 0.1609 | 4.5500 |
| −0.0715 | 0.1520 | 4.5500 |
| 0.0162 | 0.1431 | 4.5500 |
| 0.1039 | 0.1342 | 4.5500 |
| 0.1915 | 0.1252 | 4.5500 |
| 0.2792 | 0.1159 | 4.5500 |
| 0.3669 | 0.1067 | 4.5500 |
| 0.4545 | 0.0977 | 4.5500 |
| 0.5423 | 0.0891 | 4.5500 |
| 0.6301 | 0.0811 | 4.5500 |
| 0.7179 | 0.0739 | 4.5500 |
| 0.8028 | 0.0676 | 4.5500 |
| 0.8849 | 0.0625 | 4.5500 |
| 0.9641 | 0.0584 | 4.5500 |
| 1.0405 | 0.0554 | 4.5500 |
| 1.1139 | 0.0536 | 4.5500 |
| 1.1844 | 0.0527 | 4.5500 |
| 1.2519 | 0.0531 | 4.5500 |
| 1.3164 | 0.0544 | 4.5500 |
| 1.3751 | 0.0563 | 4.5500 |
| 1.4279 | 0.0588 | 4.5500 |
| 1.4748 | 0.0622 | 4.5500 |
| 1.5187 | 0.0668 | 4.5500 |
| 1.5567 | 0.0717 | 4.5500 |
| 1.5859 | 0.0756 | 4.5500 |
| 1.6092 | 0.0785 | 4.5500 |
| 1.6268 | 0.0806 | 4.5500 |
| 1.6393 | 0.0770 | 4.5500 |
| 1.6445 | 0.0719 | 4.5500 |
| 1.6468 | 0.0678 | 4.5500 |
| 1.6476 | 0.0656 | 4.5500 |
| 1.6479 | 0.0645 | 4.5500 |
| 1.6481 | 0.0639 | 4.5500 |
| 1.6437 | 0.0489 | 5.2000 |
| 1.6438 | 0.0477 | 5.2000 |
| 1.6439 | 0.0452 | 5.2000 |
| 1.6433 | 0.0404 | 5.2000 |
| 1.6400 | 0.0334 | 5.2000 |
| 1.6289 | 0.0257 | 5.2000 |
| 1.6113 | 0.0209 | 5.2000 |
| 1.5878 | 0.0149 | 5.2000 |
| 1.5583 | 0.0078 | 5.2000 |
| 1.5199 | −0.0011 | 5.2000 |
| 1.4756 | −0.0118 | 5.2000 |
| 1.4286 | −0.0238 | 5.2000 |
| 1.3758 | −0.0377 | 5.2000 |
| 1.3170 | −0.0527 | 5.2000 |
| 1.2521 | −0.0685 | 5.2000 |
| 1.1842 | −0.0844 | 5.2000 |
| 1.1131 | −0.1004 | 5.2000 |
| 1.0389 | −0.1161 | 5.2000 |
| 0.9615 | −0.1313 | 5.2000 |
| 0.8809 | −0.1458 | 5.2000 |
| 0.7971 | −0.1593 | 5.2000 |
| 0.7100 | −0.1715 | 5.2000 |
| 0.6197 | −0.1821 | 5.2000 |
| 0.5291 | −0.1906 | 5.2000 |
| 0.4387 | −0.1967 | 5.2000 |
| 0.3485 | −0.2004 | 5.2000 |
| 0.2584 | −0.2015 | 5.2000 |
| 0.1685 | −0.1999 | 5.2000 |

TABLE A-continued

| X | Y | Z |
|---|---|---|
| 0.0787 | −0.1953 | 5.2000 |
| −0.0108 | −0.1879 | 5.2000 |
| −0.1002 | −0.1779 | 5.2000 |
| −0.1894 | −0.1652 | 5.2000 |
| −0.2784 | −0.1499 | 5.2000 |
| −0.3673 | −0.1322 | 5.2000 |
| −0.4530 | −0.1128 | 5.2000 |
| −0.5352 | −0.0918 | 5.2000 |
| −0.6137 | −0.0696 | 5.2000 |
| −0.6886 | −0.0462 | 5.2000 |
| −0.7600 | −0.0219 | 5.2000 |
| −0.8279 | 0.0032 | 5.2000 |
| −0.8923 | 0.0292 | 5.2000 |
| −0.9505 | 0.0544 | 5.2000 |
| −1.0028 | 0.0783 | 5.2000 |
| −1.0490 | 0.1015 | 5.2000 |
| −1.0891 | 0.1233 | 5.2000 |
| −1.1234 | 0.1431 | 5.2000 |
| −1.1518 | 0.1608 | 5.2000 |
| −1.1755 | 0.1768 | 5.2000 |
| −1.1949 | 0.1910 | 5.2000 |
| −1.2105 | 0.2033 | 5.2000 |
| −1.2225 | 0.2137 | 5.2000 |
| −1.2310 | 0.2225 | 5.2000 |
| −1.2364 | 0.2300 | 5.2000 |
| −1.2394 | 0.2371 | 5.2000 |
| −1.2401 | 0.2432 | 5.2000 |
| −1.2394 | 0.2478 | 5.2000 |
| −1.2374 | 0.2517 | 5.2000 |
| −1.2335 | 0.2560 | 5.2000 |
| −1.2273 | 0.2598 | 5.2000 |
| −1.2191 | 0.2627 | 5.2000 |
| −1.2077 | 0.2648 | 5.2000 |
| −1.1926 | 0.2660 | 5.2000 |
| −1.1737 | 0.2668 | 5.2000 |
| −1.1507 | 0.2670 | 5.2000 |
| −1.1234 | 0.2665 | 5.2000 |
| −1.0914 | 0.2651 | 5.2000 |
| −1.0536 | 0.2626 | 5.2000 |
| −1.0102 | 0.2590 | 5.2000 |
| −0.9609 | 0.2542 | 5.2000 |
| −0.9060 | 0.2481 | 5.2000 |
| −0.8453 | 0.2412 | 5.2000 |
| −0.7788 | 0.2336 | 5.2000 |
| −0.7095 | 0.2253 | 5.2000 |
| −0.6372 | 0.2167 | 5.2000 |
| −0.5621 | 0.2077 | 5.2000 |
| −0.4841 | 0.1985 | 5.2000 |
| −0.4032 | 0.1890 | 5.2000 |
| −0.3194 | 0.1793 | 5.2000 |
| −0.2327 | 0.1695 | 5.2000 |
| −0.1459 | 0.1599 | 5.2000 |
| −0.0591 | 0.1504 | 5.2000 |
| 0.0276 | 0.1409 | 5.2000 |
| 0.1144 | 0.1315 | 5.2000 |
| 0.2012 | 0.1219 | 5.2000 |
| 0.2879 | 0.1121 | 5.2000 |
| 0.3746 | 0.1023 | 5.2000 |
| 0.4614 | 0.0928 | 5.2000 |
| 0.5482 | 0.0838 | 5.2000 |
| 0.6350 | 0.0753 | 5.2000 |
| 0.7220 | 0.0675 | 5.2000 |
| 0.8060 | 0.0607 | 5.2000 |
| 0.8873 | 0.0551 | 5.2000 |
| 0.9658 | 0.0505 | 5.2000 |
| 1.0414 | 0.0470 | 5.2000 |
| 1.1141 | 0.0445 | 5.2000 |
| 1.1840 | 0.0431 | 5.2000 |
| 1.2509 | 0.0429 | 5.2000 |
| 1.3149 | 0.0436 | 5.2000 |
| 1.3730 | 0.0449 | 5.2000 |
| 1.4254 | 0.0470 | 5.2000 |
| 1.4719 | 0.0499 | 5.2000 |
| 1.5154 | 0.0540 | 5.2000 |
| 1.5531 | 0.0584 | 5.2000 |
| 1.5821 | 0.0619 | 5.2000 |
| 1.6053 | 0.0645 | 5.2000 |
| 1.6227 | 0.0663 | 5.2000 |

TABLE A-continued

| X | Y | Z |
|---|---|---|
| 1.6351 | 0.0627 | 5.2000 |
| 1.6402 | 0.0575 | 5.2000 |
| 1.6424 | 0.0534 | 5.2000 |
| 1.6432 | 0.0512 | 5.2000 |
| 1.6435 | 0.0501 | 5.2000 |
| 1.6436 | 0.0495 | 5.2000 |
| 1.6277 | 0.0363 | 5.7200 |
| 1.6278 | 0.0351 | 5.7200 |
| 1.6279 | 0.0327 | 5.7200 |
| 1.6272 | 0.0279 | 5.7200 |
| 1.6239 | 0.0211 | 5.7200 |
| 1.6130 | 0.0135 | 5.7200 |
| 1.5956 | 0.0090 | 5.7200 |
| 1.5724 | 0.0034 | 5.7200 |
| 1.5433 | −0.0032 | 5.7200 |
| 1.5053 | −0.0114 | 5.7200 |
| 1.4617 | −0.0213 | 5.7200 |
| 1.4152 | −0.0325 | 5.7200 |
| 1.3630 | −0.0453 | 5.7200 |
| 1.3049 | −0.0592 | 5.7200 |
| 1.2409 | −0.0738 | 5.7200 |
| 1.1738 | −0.0885 | 5.7200 |
| 1.1036 | −0.1031 | 5.7200 |
| 1.0304 | −0.1175 | 5.7200 |
| 0.9540 | −0.1314 | 5.7200 |
| 0.8745 | −0.1445 | 5.7200 |
| 0.7918 | −0.1566 | 5.7200 |
| 0.7059 | −0.1675 | 5.7200 |
| 0.6168 | −0.1768 | 5.7200 |
| 0.5277 | −0.1840 | 5.7200 |
| 0.4387 | −0.1889 | 5.7200 |
| 0.3499 | −0.1915 | 5.7200 |
| 0.2612 | −0.1917 | 5.7200 |
| 0.1728 | −0.1893 | 5.7200 |
| 0.0845 | −0.1840 | 5.7200 |
| −0.0036 | −0.1761 | 5.7200 |
| −0.0915 | −0.1655 | 5.7200 |
| −0.1792 | −0.1525 | 5.7200 |
| −0.2667 | −0.1370 | 5.7200 |
| −0.3541 | −0.1192 | 5.7200 |
| −0.4384 | −0.0997 | 5.7200 |
| −0.5192 | −0.0788 | 5.7200 |
| −0.5965 | −0.0567 | 5.7200 |
| −0.6703 | −0.0336 | 5.7200 |
| −0.7405 | −0.0096 | 5.7200 |
| −0.8074 | 0.0151 | 5.7200 |
| −0.8708 | 0.0406 | 5.7200 |
| −0.9282 | 0.0653 | 5.7200 |
| −0.9797 | 0.0887 | 5.7200 |
| −1.0252 | 0.1114 | 5.7200 |
| −1.0649 | 0.1326 | 5.7200 |
| −1.0987 | 0.1519 | 5.7200 |
| −1.1268 | 0.1691 | 5.7200 |
| −1.1502 | 0.1846 | 5.7200 |
| −1.1695 | 0.1985 | 5.7200 |
| −1.1848 | 0.2106 | 5.7200 |
| −1.1966 | 0.2209 | 5.7200 |
| −1.2049 | 0.2296 | 5.7200 |
| −1.2101 | 0.2370 | 5.7200 |
| −1.2131 | 0.2440 | 5.7200 |
| −1.2139 | 0.2500 | 5.7200 |
| −1.2131 | 0.2545 | 5.7200 |
| −1.2111 | 0.2584 | 5.7200 |
| −1.2072 | 0.2625 | 5.7200 |
| −1.2011 | 0.2662 | 5.7200 |
| −1.1929 | 0.2691 | 5.7200 |
| −1.1817 | 0.2711 | 5.7200 |
| −1.1668 | 0.2722 | 5.7200 |
| −1.1482 | 0.2729 | 5.7200 |
| −1.1255 | 0.2728 | 5.7200 |
| −1.0986 | 0.2718 | 5.7200 |
| −1.0671 | 0.2698 | 5.7200 |
| −1.0299 | 0.2668 | 5.7200 |
| −0.9871 | 0.2626 | 5.7200 |
| −0.9386 | 0.2573 | 5.7200 |
| −0.8845 | 0.2505 | 5.7200 |
| −0.8248 | 0.2429 | 5.7200 |
| −0.7593 | 0.2346 | 5.7200 |

TABLE A-continued

| X | Y | Z |
|---|---|---|
| −0.6911 | 0.2256 | 5.7200 |
| −0.6200 | 0.2163 | 5.7200 |
| −0.5460 | 0.2067 | 5.7200 |
| −0.4692 | 0.1969 | 5.7200 |
| −0.3895 | 0.1868 | 5.7200 |
| −0.3069 | 0.1765 | 5.7200 |
| −0.2215 | 0.1661 | 5.7200 |
| −0.1360 | 0.1559 | 5.7200 |
| −0.0506 | 0.1459 | 5.7200 |
| 0.0349 | 0.1360 | 5.7200 |
| 0.1204 | 0.1261 | 5.7200 |
| 0.2059 | 0.1162 | 5.7200 |
| 0.2914 | 0.1061 | 5.7200 |
| 0.3768 | 0.0961 | 5.7200 |
| 0.4623 | 0.0863 | 5.7200 |
| 0.5479 | 0.0770 | 5.7200 |
| 0.6335 | 0.0683 | 5.7200 |
| 0.7191 | 0.0603 | 5.7200 |
| 0.8020 | 0.0533 | 5.7200 |
| 0.8821 | 0.0473 | 5.7200 |
| 0.9594 | 0.0425 | 5.7200 |
| 1.0340 | 0.0387 | 5.7200 |
| 1.1057 | 0.0359 | 5.7200 |
| 1.1745 | 0.0342 | 5.7200 |
| 1.2405 | 0.0336 | 5.7200 |
| 1.3036 | 0.0339 | 5.7200 |
| 1.3610 | 0.0349 | 5.7200 |
| 1.4126 | 0.0365 | 5.7200 |
| 1.4585 | 0.0391 | 5.7200 |
| 1.5015 | 0.0428 | 5.7200 |
| 1.5386 | 0.0468 | 5.7200 |
| 1.5672 | 0.0500 | 5.7200 |
| 1.5901 | 0.0523 | 5.7200 |
| 1.6073 | 0.0539 | 5.7200 |
| 1.6194 | 0.0500 | 5.7200 |
| 1.6244 | 0.0449 | 5.7200 |
| 1.6265 | 0.0408 | 5.7200 |
| 1.6272 | 0.0386 | 5.7200 |
| 1.6275 | 0.0375 | 5.7200 |
| 1.6276 | 0.0369 | 5.7200 |
| 1.5943 | 0.0182 | 6.5000 |
| 1.5944 | 0.0170 | 6.5000 |
| 1.5944 | 0.0147 | 6.5000 |
| 1.5937 | 0.0102 | 6.5000 |
| 1.5907 | 0.0037 | 6.5000 |
| 1.5804 | −0.0038 | 6.5000 |
| 1.5635 | −0.0078 | 6.5000 |
| 1.5408 | −0.0126 | 6.5000 |
| 1.5124 | −0.0183 | 6.5000 |
| 1.4754 | −0.0253 | 6.5000 |
| 1.4327 | −0.0336 | 6.5000 |
| 1.3873 | −0.0430 | 6.5000 |
| 1.3363 | −0.0538 | 6.5000 |
| 1.2795 | −0.0654 | 6.5000 |
| 1.2169 | −0.0775 | 6.5000 |
| 1.1514 | −0.0896 | 6.5000 |
| 1.0829 | −0.1016 | 6.5000 |
| 1.0114 | −0.1132 | 6.5000 |
| 0.9369 | −0.1242 | 6.5000 |
| 0.8593 | −0.1345 | 6.5000 |
| 0.7787 | −0.1437 | 6.5000 |
| 0.6951 | −0.1518 | 6.5000 |
| 0.6085 | −0.1583 | 6.5000 |
| 0.5218 | −0.1629 | 6.5000 |
| 0.4349 | −0.1655 | 6.5000 |
| 0.3481 | −0.1660 | 6.5000 |
| 0.2616 | −0.1643 | 6.5000 |
| 0.1755 | −0.1604 | 6.5000 |
| 0.0897 | −0.1539 | 6.5000 |
| 0.0042 | −0.1450 | 6.5000 |
| −0.0809 | −0.1338 | 6.5000 |
| −0.1658 | −0.1203 | 6.5000 |
| −0.2503 | −0.1046 | 6.5000 |
| −0.3345 | −0.0869 | 6.5000 |
| −0.4157 | −0.0677 | 6.5000 |
| −0.4938 | −0.0474 | 6.5000 |
| −0.5689 | −0.0258 | 6.5000 |
| −0.6407 | −0.0034 | 6.5000 |

TABLE A-continued

| X | Y | Z |
|---|---|---|
| −0.7092 | 0.0198 | 6.5000 |
| −0.7743 | 0.0435 | 6.5000 |
| −0.8360 | 0.0678 | 6.5000 |
| −0.8919 | 0.0913 | 6.5000 |
| −0.9421 | 0.1135 | 6.5000 |
| −0.9864 | 0.1348 | 6.5000 |
| −1.0250 | 0.1547 | 6.5000 |
| −1.0582 | 0.1728 | 6.5000 |
| −1.0857 | 0.1890 | 6.5000 |
| −1.1088 | 0.2035 | 6.5000 |
| −1.1277 | 0.2164 | 6.5000 |
| −1.1430 | 0.2275 | 6.5000 |
| −1.1550 | 0.2368 | 6.5000 |
| −1.1634 | 0.2446 | 6.5000 |
| −1.1690 | 0.2514 | 6.5000 |
| −1.1725 | 0.2578 | 6.5000 |
| −1.1738 | 0.2635 | 6.5000 |
| −1.1732 | 0.2679 | 6.5000 |
| −1.1711 | 0.2715 | 6.5000 |
| −1.1669 | 0.2751 | 6.5000 |
| −1.1605 | 0.2780 | 6.5000 |
| −1.1523 | 0.2799 | 6.5000 |
| −1.1412 | 0.2809 | 6.5000 |
| −1.1267 | 0.2809 | 6.5000 |
| −1.1085 | 0.2805 | 6.5000 |
| −1.0864 | 0.2793 | 6.5000 |
| −1.0602 | 0.2773 | 6.5000 |
| −1.0296 | 0.2743 | 6.5000 |
| −0.9934 | 0.2701 | 6.5000 |
| −0.9518 | 0.2648 | 6.5000 |
| −0.9048 | 0.2581 | 6.5000 |
| −0.8522 | 0.2499 | 6.5000 |
| −0.7942 | 0.2410 | 6.5000 |
| −0.7306 | 0.2311 | 6.5000 |
| −0.6643 | 0.2207 | 6.5000 |
| −0.5952 | 0.2100 | 6.5000 |
| −0.5233 | 0.1991 | 6.5000 |
| −0.4486 | 0.1879 | 6.5000 |
| −0.3711 | 0.1766 | 6.5000 |
| −0.2908 | 0.1651 | 6.5000 |
| −0.2077 | 0.1536 | 6.5000 |
| −0.1245 | 0.1424 | 6.5000 |
| −0.0413 | 0.1315 | 6.5000 |
| 0.0419 | 0.1209 | 6.5000 |
| 0.1252 | 0.1103 | 6.5000 |
| 0.2084 | 0.0999 | 6.5000 |
| 0.2917 | 0.0894 | 6.5000 |
| 0.3750 | 0.0793 | 6.5000 |
| 0.4583 | 0.0696 | 6.5000 |
| 0.5417 | 0.0604 | 6.5000 |
| 0.6251 | 0.0519 | 6.5000 |
| 0.7087 | 0.0441 | 6.5000 |
| 0.7895 | 0.0373 | 6.5000 |
| 0.8676 | 0.0316 | 6.5000 |
| 0.9430 | 0.0270 | 6.5000 |
| 1.0157 | 0.0233 | 6.5000 |
| 1.0856 | 0.0206 | 6.5000 |
| 1.1527 | 0.0190 | 6.5000 |
| 1.2170 | 0.0183 | 6.5000 |
| 1.2786 | 0.0186 | 6.5000 |
| 1.3345 | 0.0193 | 6.5000 |
| 1.3848 | 0.0208 | 6.5000 |
| 1.4296 | 0.0230 | 6.5000 |
| 1.4715 | 0.0262 | 6.5000 |
| 1.5078 | 0.0298 | 6.5000 |
| 1.5357 | 0.0325 | 6.5000 |
| 1.5580 | 0.0346 | 6.5000 |
| 1.5748 | 0.0359 | 6.5000 |
| 1.5865 | 0.0317 | 6.5000 |
| 1.5912 | 0.0266 | 6.5000 |
| 1.5932 | 0.0225 | 6.5000 |
| 1.5938 | 0.0204 | 6.5000 |
| 1.5941 | 0.0193 | 6.5000 |
| 1.5942 | 0.0188 | 6.5000 |
| 1.5642 | 0.0033 | 7.1500 |
| 1.5643 | 0.0022 | 7.1500 |
| 1.5643 | −0.0001 | 7.1500 |
| 1.5636 | −0.0045 | 7.1500 |

TABLE A-continued

| X | Y | Z |
|---|---|---|
| 1.5605 | −0.0109 | 7.1500 |
| 1.5503 | −0.0182 | 7.1500 |
| 1.5337 | −0.0216 | 7.1500 |
| 1.5115 | −0.0257 | 7.1500 |
| 1.4837 | −0.0305 | 7.1500 |
| 1.4474 | −0.0364 | 7.1500 |
| 1.4057 | −0.0434 | 7.1500 |
| 1.3612 | −0.0512 | 7.1500 |
| 1.3111 | −0.0601 | 7.1500 |
| 1.2555 | −0.0696 | 7.1500 |
| 1.1941 | −0.0794 | 7.1500 |
| 1.1299 | −0.0891 | 7.1500 |
| 1.0628 | −0.0986 | 7.1500 |
| 0.9928 | −0.1076 | 7.1500 |
| 0.9199 | −0.1161 | 7.1500 |
| 0.8441 | −0.1237 | 7.1500 |
| 0.7653 | −0.1303 | 7.1500 |
| 0.6837 | −0.1357 | 7.1500 |
| 0.5991 | −0.1397 | 7.1500 |
| 0.5145 | −0.1419 | 7.1500 |
| 0.4298 | −0.1423 | 7.1500 |
| 0.3454 | −0.1408 | 7.1500 |
| 0.2613 | −0.1374 | 7.1500 |
| 0.1776 | −0.1320 | 7.1500 |
| 0.0942 | −0.1244 | 7.1500 |
| 0.0112 | −0.1146 | 7.1500 |
| −0.0715 | −0.1028 | 7.1500 |
| −0.1538 | −0.0889 | 7.1500 |
| −0.2359 | −0.0731 | 7.1500 |
| −0.3176 | −0.0555 | 7.1500 |
| −0.3963 | −0.0366 | 7.1500 |
| −0.4720 | −0.0168 | 7.1500 |
| −0.5448 | 0.0041 | 7.1500 |
| −0.6146 | 0.0257 | 7.1500 |
| −0.6814 | 0.0480 | 7.1500 |
| −0.7452 | 0.0707 | 7.1500 |
| −0.8058 | 0.0939 | 7.1500 |
| −0.8605 | 0.1163 | 7.1500 |
| −0.9097 | 0.1375 | 7.1500 |
| −0.9532 | 0.1575 | 7.1500 |
| −0.9912 | 0.1761 | 7.1500 |
| −1.0238 | 0.1931 | 7.1500 |
| −1.0510 | 0.2082 | 7.1500 |
| −1.0739 | 0.2216 | 7.1500 |
| −1.0930 | 0.2333 | 7.1500 |
| −1.1084 | 0.2432 | 7.1500 |
| −1.1206 | 0.2516 | 7.1500 |
| −1.1293 | 0.2588 | 7.1500 |
| −1.1352 | 0.2649 | 7.1500 |
| −1.1392 | 0.2707 | 7.1500 |
| −1.1411 | 0.2761 | 7.1500 |
| −1.1407 | 0.2804 | 7.1500 |
| −1.1384 | 0.2838 | 7.1500 |
| −1.1339 | 0.2868 | 7.1500 |
| −1.1273 | 0.2888 | 7.1500 |
| −1.1192 | 0.2898 | 7.1500 |
| −1.1083 | 0.2899 | 7.1500 |
| −1.0941 | 0.2889 | 7.1500 |
| −1.0764 | 0.2871 | 7.1500 |
| −1.0549 | 0.2847 | 7.1500 |
| −1.0294 | 0.2815 | 7.1500 |
| −0.9995 | 0.2773 | 7.1500 |
| −0.9644 | 0.2718 | 7.1500 |
| −0.9239 | 0.2652 | 7.1500 |
| −0.8780 | 0.2570 | 7.1500 |
| −0.8269 | 0.2476 | 7.1500 |
| −0.7703 | 0.2372 | 7.1500 |
| −0.7084 | 0.2259 | 7.1500 |
| −0.6438 | 0.2142 | 7.1500 |
| −0.5764 | 0.2021 | 7.1500 |
| −0.5063 | 0.1899 | 7.1500 |
| −0.4334 | 0.1775 | 7.1500 |
| −0.3578 | 0.1650 | 7.1500 |
| −0.2794 | 0.1524 | 7.1500 |
| −0.1983 | 0.1399 | 7.1500 |
| −0.1170 | 0.1279 | 7.1500 |
| −0.0357 | 0.1162 | 7.1500 |
| 0.0456 | 0.1049 | 7.1500 |

TABLE A-continued

| X | Y | Z |
|---|---|---|
| 0.1270 | 0.0939 | 7.1500 |
| 0.2084 | 0.0831 | 7.1500 |
| 0.2898 | 0.0726 | 7.1500 |
| 0.3713 | 0.0624 | 7.1500 |
| 0.4528 | 0.0529 | 7.1500 |
| 0.5344 | 0.0440 | 7.1500 |
| 0.6161 | 0.0359 | 7.1500 |
| 0.6978 | 0.0284 | 7.1500 |
| 0.7769 | 0.0221 | 7.1500 |
| 0.8534 | 0.0168 | 7.1500 |
| 0.9272 | 0.0125 | 7.1500 |
| 0.9983 | 0.0092 | 7.1500 |
| 1.0668 | 0.0068 | 7.1500 |
| 1.1324 | 0.0054 | 7.1500 |
| 1.1954 | 0.0049 | 7.1500 |
| 1.2556 | 0.0052 | 7.1500 |
| 1.3104 | 0.0060 | 7.1500 |
| 1.3597 | 0.0074 | 7.1500 |
| 1.4035 | 0.0095 | 7.1500 |
| 1.4445 | 0.0125 | 7.1500 |
| 1.4799 | 0.0156 | 7.1500 |
| 1.5072 | 0.0181 | 7.1500 |
| 1.5291 | 0.0200 | 7.1500 |
| 1.5455 | 0.0211 | 7.1500 |
| 1.5568 | 0.0167 | 7.1500 |
| 1.5614 | 0.0116 | 7.1500 |
| 1.5632 | 0.0076 | 7.1500 |
| 1.5638 | 0.0055 | 7.1500 |
| 1.5641 | 0.0044 | 7.1500 |
| 1.5641 | 0.0039 | 7.1500 |
| 1.5370 | −0.0126 | 7.8000 |
| 1.5371 | −0.0137 | 7.8000 |
| 1.5371 | −0.0159 | 7.8000 |
| 1.5363 | −0.0203 | 7.8000 |
| 1.5332 | −0.0264 | 7.8000 |
| 1.5231 | −0.0335 | 7.8000 |
| 1.5069 | −0.0365 | 7.8000 |
| 1.4851 | −0.0400 | 7.8000 |
| 1.4578 | −0.0440 | 7.8000 |
| 1.4224 | −0.0489 | 7.8000 |
| 1.3814 | −0.0548 | 7.8000 |
| 1.3378 | −0.0613 | 7.8000 |
| 1.2887 | −0.0686 | 7.8000 |
| 1.2341 | −0.0763 | 7.8000 |
| 1.1740 | −0.0842 | 7.8000 |
| 1.1111 | −0.0919 | 7.8000 |
| 1.0454 | −0.0992 | 7.8000 |
| 0.9768 | −0.1061 | 7.8000 |
| 0.9054 | −0.1123 | 7.8000 |
| 0.8312 | −0.1177 | 7.8000 |
| 0.7542 | −0.1221 | 7.8000 |
| 0.6744 | −0.1253 | 7.8000 |
| 0.5917 | −0.1270 | 7.8000 |
| 0.5091 | −0.1271 | 7.8000 |
| 0.4265 | −0.1256 | 7.8000 |
| 0.3442 | −0.1223 | 7.8000 |
| 0.2622 | −0.1171 | 7.8000 |
| 0.1806 | −0.1100 | 7.8000 |
| 0.0994 | −0.1009 | 7.8000 |
| 0.0185 | −0.0899 | 7.8000 |
| −0.0620 | −0.0771 | 7.8000 |
| −0.1422 | −0.0626 | 7.8000 |
| −0.2221 | −0.0464 | 7.8000 |
| −0.3017 | −0.0286 | 7.8000 |
| −0.3783 | −0.0098 | 7.8000 |
| −0.4520 | 0.0099 | 7.8000 |
| −0.5228 | 0.0303 | 7.8000 |
| −0.5907 | 0.0513 | 7.8000 |
| −0.6557 | 0.0728 | 7.8000 |
| −0.7179 | 0.0948 | 7.8000 |
| −0.7773 | 0.1171 | 7.8000 |
| −0.8310 | 0.1385 | 7.8000 |
| −0.8792 | 0.1587 | 7.8000 |
| −0.9220 | 0.1776 | 7.8000 |
| −0.9594 | 0.1951 | 7.8000 |
| −0.9915 | 0.2110 | 7.8000 |
| −1.0184 | 0.2250 | 7.8000 |
| −1.0412 | 0.2374 | 7.8000 |

TABLE A-continued

| X | Y | Z |
|---|---|---|
| −1.0602 | 0.2481 | 7.8000 |
| −1.0758 | 0.2570 | 7.8000 |
| −1.0879 | 0.2647 | 7.8000 |
| −1.0967 | 0.2714 | 7.8000 |
| −1.1028 | 0.2770 | 7.8000 |
| −1.1070 | 0.2825 | 7.8000 |
| −1.1092 | 0.2877 | 7.8000 |
| −1.1089 | 0.2918 | 7.8000 |
| −1.1066 | 0.2950 | 7.8000 |
| −1.1018 | 0.2976 | 7.8000 |
| −1.0953 | 0.2990 | 7.8000 |
| −1.0873 | 0.2995 | 7.8000 |
| −1.0766 | 0.2990 | 7.8000 |
| −1.0627 | 0.2973 | 7.8000 |
| −1.0455 | 0.2944 | 7.8000 |
| −1.0247 | 0.2908 | 7.8000 |
| −0.9998 | 0.2864 | 7.8000 |
| −0.9708 | 0.2809 | 7.8000 |
| −0.9366 | 0.2742 | 7.8000 |
| −0.8972 | 0.2661 | 7.8000 |
| −0.8526 | 0.2566 | 7.8000 |
| −0.8028 | 0.2459 | 7.8000 |
| −0.7477 | 0.2341 | 7.8000 |
| −0.6873 | 0.2214 | 7.8000 |
| −0.6242 | 0.2084 | 7.8000 |
| −0.5585 | 0.1951 | 7.8000 |
| −0.4900 | 0.1817 | 7.8000 |
| −0.4189 | 0.1682 | 7.8000 |
| −0.3450 | 0.1546 | 7.8000 |
| −0.2684 | 0.1411 | 7.8000 |
| −0.1891 | 0.1277 | 7.8000 |
| −0.1096 | 0.1149 | 7.8000 |
| −0.0301 | 0.1026 | 7.8000 |
| 0.0495 | 0.0909 | 7.8000 |
| 0.1291 | 0.0797 | 7.8000 |
| 0.2089 | 0.0689 | 7.8000 |
| 0.2887 | 0.0585 | 7.8000 |
| 0.3685 | 0.0484 | 7.8000 |
| 0.4484 | 0.0389 | 7.8000 |
| 0.5283 | 0.0301 | 7.8000 |
| 0.6083 | 0.0220 | 7.8000 |
| 0.6884 | 0.0147 | 7.8000 |
| 0.7659 | 0.0085 | 7.8000 |
| 0.8408 | 0.0033 | 7.8000 |
| 0.9130 | −0.0010 | 7.8000 |
| 0.9827 | −0.0042 | 7.8000 |
| 1.0498 | −0.0066 | 7.8000 |
| 1.1142 | −0.0080 | 7.8000 |
| 1.1759 | −0.0086 | 7.8000 |
| 1.2349 | −0.0085 | 7.8000 |
| 1.2885 | −0.0078 | 7.8000 |
| 1.3368 | −0.0066 | 7.8000 |
| 1.3797 | −0.0048 | 7.8000 |
| 1.4199 | −0.0023 | 7.8000 |
| 1.4547 | 0.0005 | 7.8000 |
| 1.4815 | 0.0027 | 7.8000 |
| 1.5029 | 0.0044 | 7.8000 |
| 1.5190 | 0.0053 | 7.8000 |
| 1.5300 | 0.0007 | 7.8000 |
| 1.5344 | −0.0044 | 7.8000 |
| 1.5362 | −0.0084 | 7.8000 |
| 1.5367 | −0.0104 | 7.8000 |
| 1.5369 | −0.0115 | 7.8000 |
| 1.5370 | −0.0120 | 7.8000 |
| 1.5161 | −0.0295 | 8.4500 |
| 1.5162 | −0.0306 | 8.4500 |
| 1.5161 | −0.0328 | 8.4500 |
| 1.5153 | −0.0370 | 8.4500 |
| 1.5122 | −0.0430 | 8.4500 |
| 1.5024 | −0.0499 | 8.4500 |
| 1.4865 | −0.0526 | 8.4500 |
| 1.4651 | −0.0557 | 8.4500 |
| 1.4384 | −0.0592 | 8.4500 |
| 1.4036 | −0.0635 | 8.4500 |
| 1.3634 | −0.0687 | 8.4500 |
| 1.3207 | −0.0745 | 8.4500 |
| 1.2725 | −0.0809 | 8.4500 |
| 1.2190 | −0.0876 | 8.4500 |

TABLE A-continued

| X | Y | Z |
|---|---|---|
| 1.1600 | −0.0944 | 8.4500 |
| 1.0983 | −0.1009 | 8.4500 |
| 1.0339 | −0.1071 | 8.4500 |
| 0.9667 | −0.1128 | 8.4500 |
| 0.8967 | −0.1177 | 8.4500 |
| 0.8240 | −0.1218 | 8.4500 |
| 0.7485 | −0.1248 | 8.4500 |
| 0.6703 | −0.1265 | 8.4500 |
| 0.5894 | −0.1267 | 8.4500 |
| 0.5086 | −0.1252 | 8.4500 |
| 0.4278 | −0.1220 | 8.4500 |
| 0.3471 | −0.1169 | 8.4500 |
| 0.2665 | −0.1098 | 8.4500 |
| 0.1863 | −0.1006 | 8.4500 |
| 0.1065 | −0.0897 | 8.4500 |
| 0.0271 | −0.0772 | 8.4500 |
| −0.0520 | −0.0631 | 8.4500 |
| −0.1307 | −0.0476 | 8.4500 |
| −0.2091 | −0.0306 | 8.4500 |
| −0.2871 | −0.0122 | 8.4500 |
| −0.3622 | 0.0071 | 8.4500 |
| −0.4344 | 0.0270 | 8.4500 |
| −0.5038 | 0.0475 | 8.4500 |
| −0.5702 | 0.0684 | 8.4500 |
| −0.6339 | 0.0897 | 8.4500 |
| −0.6947 | 0.1113 | 8.4500 |
| −0.7527 | 0.1331 | 8.4500 |
| −0.8054 | 0.1538 | 8.4500 |
| −0.8528 | 0.1733 | 8.4500 |
| −0.8948 | 0.1916 | 8.4500 |
| −0.9315 | 0.2085 | 8.4500 |
| −0.9631 | 0.2238 | 8.4500 |
| −0.9896 | 0.2371 | 8.4500 |
| −1.0121 | 0.2488 | 8.4500 |
| −1.0309 | 0.2589 | 8.4500 |
| −1.0462 | 0.2674 | 8.4500 |
| −1.0582 | 0.2747 | 8.4500 |
| −1.0670 | 0.2811 | 8.4500 |
| −1.0730 | 0.2866 | 8.4500 |
| −1.0772 | 0.2919 | 8.4500 |
| −1.0793 | 0.2969 | 8.4500 |
| −1.0790 | 0.3010 | 8.4500 |
| −1.0767 | 0.3041 | 8.4500 |
| −1.0720 | 0.3065 | 8.4500 |
| −1.0655 | 0.3077 | 8.4500 |
| −1.0576 | 0.3080 | 8.4500 |
| −1.0471 | 0.3071 | 8.4500 |
| −1.0336 | 0.3048 | 8.4500 |
| −1.0168 | 0.3014 | 8.4500 |
| −0.9965 | 0.2971 | 8.4500 |
| −0.9723 | 0.2918 | 8.4500 |
| −0.9440 | 0.2854 | 8.4500 |
| −0.9106 | 0.2778 | 8.4500 |
| −0.8721 | 0.2688 | 8.4500 |
| −0.8285 | 0.2584 | 8.4500 |
| −0.7798 | 0.2466 | 8.4500 |
| −0.7260 | 0.2337 | 8.4500 |
| −0.6670 | 0.2200 | 8.4500 |
| −0.6053 | 0.2060 | 8.4500 |
| −0.5409 | 0.1919 | 8.4500 |
| −0.4739 | 0.1776 | 8.4500 |
| −0.4042 | 0.1633 | 8.4500 |
| −0.3318 | 0.1490 | 8.4500 |
| −0.2567 | 0.1348 | 8.4500 |
| −0.1790 | 0.1209 | 8.4500 |
| −0.1011 | 0.1076 | 8.4500 |
| −0.0231 | 0.0951 | 8.4500 |
| 0.0551 | 0.0833 | 8.4500 |
| 0.1333 | 0.0722 | 8.4500 |
| 0.2117 | 0.0617 | 8.4500 |
| 0.2901 | 0.0517 | 8.4500 |
| 0.3686 | 0.0420 | 8.4500 |
| 0.4470 | 0.0326 | 8.4500 |
| 0.5256 | 0.0237 | 8.4500 |
| 0.6042 | 0.0153 | 8.4500 |
| 0.6828 | 0.0076 | 8.4500 |
| 0.7589 | 0.0008 | 8.4500 |
| 0.8324 | −0.0050 | 8.4500 |

TABLE A-continued

| X | Y | Z |
|---|---|---|
| 0.9034 | −0.0098 | 8.4500 |
| 0.9719 | −0.0138 | 8.4500 |
| 1.0377 | −0.0169 | 8.4500 |
| 1.1009 | −0.0191 | 8.4500 |
| 1.1615 | −0.0204 | 8.4500 |
| 1.2195 | −0.0210 | 8.4500 |
| 1.2722 | −0.0210 | 8.4500 |
| 1.3197 | −0.0204 | 8.4500 |
| 1.3619 | −0.0194 | 8.4500 |
| 1.4014 | −0.0176 | 8.4500 |
| 1.4356 | −0.0153 | 8.4500 |
| 1.4619 | −0.0136 | 8.4500 |
| 1.4830 | −0.0122 | 8.4500 |
| 1.4988 | −0.0115 | 8.4500 |
| 1.5095 | −0.0163 | 8.4500 |
| 1.5137 | −0.0214 | 8.4500 |
| 1.5153 | −0.0253 | 8.4500 |
| 1.5159 | −0.0274 | 8.4500 |
| 1.5160 | −0.0284 | 8.4500 |
| 1.5161 | −0.0290 | 8.4500 |
| 1.5005 | −0.0441 | 9.0455 |
| 1.5005 | −0.0452 | 9.0455 |
| 1.5005 | −0.0474 | 9.0455 |
| 1.4996 | −0.0516 | 9.0455 |
| 1.4964 | −0.0575 | 9.0455 |
| 1.4865 | −0.0643 | 9.0455 |
| 1.4708 | −0.0668 | 9.0455 |
| 1.4497 | −0.0696 | 9.0455 |
| 1.4234 | −0.0729 | 9.0455 |
| 1.3890 | −0.0770 | 9.0455 |
| 1.3495 | −0.0821 | 9.0455 |
| 1.3073 | −0.0879 | 9.0455 |
| 1.2599 | −0.0940 | 9.0455 |
| 1.2071 | −0.1004 | 9.0455 |
| 1.1489 | −0.1071 | 9.0455 |
| 1.0881 | −0.1134 | 9.0455 |
| 1.0246 | −0.1194 | 9.0455 |
| 0.9583 | −0.1247 | 9.0455 |
| 0.8894 | −0.1292 | 9.0455 |
| 0.8177 | −0.1328 | 9.0455 |
| 0.7433 | −0.1351 | 9.0455 |
| 0.6662 | −0.1360 | 9.0455 |
| 0.5865 | −0.1351 | 9.0455 |
| 0.5069 | −0.1322 | 9.0455 |
| 0.4274 | −0.1271 | 9.0455 |
| 0.3482 | −0.1197 | 9.0455 |
| 0.2692 | −0.1104 | 9.0455 |
| 0.1902 | −0.0995 | 9.0455 |
| 0.1115 | −0.0872 | 9.0455 |
| 0.0332 | −0.0735 | 9.0455 |
| −0.0448 | −0.0584 | 9.0455 |
| −0.1224 | −0.0420 | 9.0455 |
| −0.1997 | −0.0242 | 9.0455 |
| −0.2766 | −0.0050 | 9.0455 |
| −0.3505 | 0.0148 | 9.0455 |
| −0.4216 | 0.0352 | 9.0455 |
| −0.4899 | 0.0560 | 9.0455 |
| −0.5553 | 0.0772 | 9.0455 |
| −0.6179 | 0.0987 | 9.0455 |
| −0.6777 | 0.1204 | 9.0455 |
| −0.7347 | 0.1422 | 9.0455 |
| −0.7866 | 0.1629 | 9.0455 |
| −0.8331 | 0.1825 | 9.0455 |
| −0.8744 | 0.2008 | 9.0455 |
| −0.9106 | 0.2176 | 9.0455 |
| −0.9417 | 0.2326 | 9.0455 |
| −0.9678 | 0.2457 | 9.0455 |
| −0.9900 | 0.2572 | 9.0455 |
| −1.0085 | 0.2672 | 9.0455 |
| −1.0236 | 0.2756 | 9.0455 |
| −1.0355 | 0.2828 | 9.0455 |
| −1.0441 | 0.2891 | 9.0455 |
| −1.0500 | 0.2945 | 9.0455 |
| −1.0542 | 0.2997 | 9.0455 |
| −1.0563 | 0.3046 | 9.0455 |
| −1.0561 | 0.3087 | 9.0455 |
| −1.0537 | 0.3117 | 9.0455 |
| −1.0490 | 0.3138 | 9.0455 |

TABLE A-continued

| X | Y | Z |
|---|---|---|
| −1.0426 | 0.3149 | 9.0455 |
| −1.0348 | 0.3150 | 9.0455 |
| −1.0245 | 0.3139 | 9.0455 |
| −1.0112 | 0.3115 | 9.0455 |
| −0.9947 | 0.3078 | 9.0455 |
| −0.9747 | 0.3032 | 9.0455 |
| −0.9509 | 0.2975 | 9.0455 |
| −0.9232 | 0.2907 | 9.0455 |
| −0.8904 | 0.2826 | 9.0455 |
| −0.8525 | 0.2731 | 9.0455 |
| −0.8097 | 0.2624 | 9.0455 |
| −0.7618 | 0.2502 | 9.0455 |
| −0.7089 | 0.2369 | 9.0455 |
| −0.6508 | 0.2227 | 9.0455 |
| −0.5901 | 0.2083 | 9.0455 |
| −0.5267 | 0.1938 | 9.0455 |
| −0.4608 | 0.1791 | 9.0455 |
| −0.3921 | 0.1645 | 9.0455 |
| −0.3209 | 0.1499 | 9.0455 |
| −0.2469 | 0.1355 | 9.0455 |
| −0.1703 | 0.1212 | 9.0455 |
| −0.0935 | 0.1077 | 9.0455 |
| −0.0167 | 0.0950 | 9.0455 |
| 0.0604 | 0.0830 | 9.0455 |
| 0.1375 | 0.0718 | 9.0455 |
| 0.2148 | 0.0614 | 9.0455 |
| 0.2922 | 0.0519 | 9.0455 |
| 0.3696 | 0.0430 | 9.0455 |
| 0.4471 | 0.0344 | 9.0455 |
| 0.5246 | 0.0258 | 9.0455 |
| 0.6021 | 0.0172 | 9.0455 |
| 0.6796 | 0.0089 | 9.0455 |
| 0.7545 | 0.0013 | 9.0455 |
| 0.8270 | −0.0056 | 9.0455 |
| 0.8969 | −0.0116 | 9.0455 |
| 0.9643 | −0.0168 | 9.0455 |
| 1.0291 | −0.0212 | 9.0455 |
| 1.0914 | −0.0247 | 9.0455 |
| 1.1511 | −0.0275 | 9.0455 |
| 1.2082 | −0.0294 | 9.0455 |
| 1.2602 | −0.0304 | 9.0455 |
| 1.3069 | −0.0310 | 9.0455 |
| 1.3485 | −0.0310 | 9.0455 |
| 1.3875 | −0.0301 | 9.0455 |
| 1.4213 | −0.0286 | 9.0455 |
| 1.4473 | −0.0273 | 9.0455 |
| 1.4681 | −0.0264 | 9.0455 |
| 1.4837 | −0.0260 | 9.0455 |
| 1.4942 | −0.0310 | 9.0455 |
| 1.4982 | −0.0361 | 9.0455 |
| 1.4998 | −0.0400 | 9.0455 |
| 1.5002 | −0.0420 | 9.0455 |
| 1.5004 | −0.0430 | 9.0455 |
| 1.5005 | −0.0435 | 9.0455 |
| 1.4923 | −0.0538 | 9.3705 |
| 1.4923 | −0.0549 | 9.3705 |
| 1.4922 | −0.0570 | 9.3705 |
| 1.4913 | −0.0612 | 9.3705 |
| 1.4882 | −0.0670 | 9.3705 |
| 1.4785 | −0.0737 | 9.3705 |
| 1.4629 | −0.0762 | 9.3705 |
| 1.4420 | −0.0790 | 9.3705 |
| 1.4157 | −0.0822 | 9.3705 |
| 1.3816 | −0.0861 | 9.3705 |
| 1.3423 | −0.0911 | 9.3705 |
| 1.3004 | −0.0968 | 9.3705 |
| 1.2532 | −0.1029 | 9.3705 |
| 1.2007 | −0.1091 | 9.3705 |
| 1.1429 | −0.1157 | 9.3705 |
| 1.0825 | −0.1220 | 9.3705 |
| 1.0193 | −0.1278 | 9.3705 |
| 0.9534 | −0.1330 | 9.3705 |
| 0.8849 | −0.1373 | 9.3705 |
| 0.8136 | −0.1406 | 9.3705 |
| 0.7397 | −0.1426 | 9.3705 |
| 0.6631 | −0.1431 | 9.3705 |
| 0.5838 | −0.1418 | 9.3705 |
| 0.5048 | −0.1381 | 9.3705 |

TABLE A-continued

| X | Y | Z |
|---|---|---|
| 0.4260 | −0.1320 | 9.3705 |
| 0.3473 | −0.1236 | 9.3705 |
| 0.2688 | −0.1136 | 9.3705 |
| 0.1904 | −0.1020 | 9.3705 |
| 0.1124 | −0.0892 | 9.3705 |
| 0.0348 | −0.0749 | 9.3705 |
| −0.0425 | −0.0593 | 9.3705 |
| −0.1195 | −0.0424 | 9.3705 |
| −0.1961 | −0.0241 | 9.3705 |
| −0.2723 | −0.0045 | 9.3705 |
| −0.3456 | 0.0158 | 9.3705 |
| −0.4161 | 0.0366 | 9.3705 |
| −0.4837 | 0.0577 | 9.3705 |
| −0.5486 | 0.0793 | 9.3705 |
| −0.6106 | 0.1011 | 9.3705 |
| −0.6699 | 0.1231 | 9.3705 |
| −0.7265 | 0.1451 | 9.3705 |
| −0.7779 | 0.1661 | 9.3705 |
| −0.8240 | 0.1859 | 9.3705 |
| −0.8649 | 0.2044 | 9.3705 |
| −0.9008 | 0.2213 | 9.3705 |
| −0.9316 | 0.2364 | 9.3705 |
| −0.9575 | 0.2496 | 9.3705 |
| −0.9795 | 0.2612 | 9.3705 |
| −0.9978 | 0.2713 | 9.3705 |
| −1.0127 | 0.2798 | 9.3705 |
| −1.0244 | 0.2870 | 9.3705 |
| −1.0329 | 0.2933 | 9.3705 |
| −1.0388 | 0.2987 | 9.3705 |
| −1.0429 | 0.3040 | 9.3705 |
| −1.0450 | 0.3089 | 9.3705 |
| −1.0447 | 0.3129 | 9.3705 |
| −1.0423 | 0.3158 | 9.3705 |
| −1.0376 | 0.3180 | 9.3705 |
| −1.0313 | 0.3190 | 9.3705 |
| −1.0235 | 0.3191 | 9.3705 |
| −1.0133 | 0.3180 | 9.3705 |
| −1.0001 | 0.3155 | 9.3705 |
| −0.9837 | 0.3119 | 9.3705 |
| −0.9638 | 0.3072 | 9.3705 |
| −0.9403 | 0.3015 | 9.3705 |
| −0.9127 | 0.2946 | 9.3705 |
| −0.8802 | 0.2864 | 9.3705 |
| −0.8427 | 0.2768 | 9.3705 |
| −0.8001 | 0.2659 | 9.3705 |
| −0.7526 | 0.2537 | 9.3705 |
| −0.7001 | 0.2403 | 9.3705 |
| −0.6425 | 0.2258 | 9.3705 |
| −0.5823 | 0.2113 | 9.3705 |
| −0.5195 | 0.1965 | 9.3705 |
| −0.4540 | 0.1817 | 9.3705 |
| −0.3859 | 0.1668 | 9.3705 |
| −0.3152 | 0.1520 | 9.3705 |
| −0.2418 | 0.1373 | 9.3705 |
| −0.1657 | 0.1228 | 9.3705 |
| −0.0895 | 0.1091 | 9.3705 |
| −0.0132 | 0.0960 | 9.3705 |
| 0.0632 | 0.0838 | 9.3705 |
| 0.1398 | 0.0723 | 9.3705 |
| 0.2165 | 0.0617 | 9.3705 |
| 0.2933 | 0.0519 | 9.3705 |
| 0.3702 | 0.0429 | 9.3705 |
| 0.4471 | 0.0344 | 9.3705 |
| 0.5241 | 0.0259 | 9.3705 |
| 0.6010 | 0.0171 | 9.3705 |
| 0.6779 | 0.0082 | 9.3705 |
| 0.7522 | 0.0000 | 9.3705 |
| 0.8241 | −0.0075 | 9.3705 |
| 0.8935 | −0.0142 | 9.3705 |
| 0.9603 | −0.0202 | 9.3705 |
| 1.0246 | −0.0253 | 9.3705 |
| 1.0864 | −0.0296 | 9.3705 |
| 1.1456 | −0.0331 | 9.3705 |
| 1.2023 | −0.0357 | 9.3705 |
| 1.2539 | −0.0374 | 9.3705 |
| 1.3003 | −0.0385 | 9.3705 |
| 1.3416 | −0.0391 | 9.3705 |
| 1.3803 | −0.0387 | 9.3705 |

TABLE A-continued

| X | Y | Z |
|---|---|---|
| 1.4139 | −0.0376 | 9.3705 |
| 1.4397 | −0.0366 | 9.3705 |
| 1.4603 | −0.0359 | 9.3705 |
| 1.4758 | −0.0357 | 9.3705 |
| 1.4861 | −0.0408 | 9.3705 |
| 1.4900 | −0.0459 | 9.3705 |
| 1.4916 | −0.0497 | 9.3705 |
| 1.4920 | −0.0518 | 9.3705 |
| 1.4922 | −0.0528 | 9.3705 |
| 1.4922 | −0.0533 | 9.3705 |
| 1.4840 | −0.0642 | 9.6955 |
| 1.4840 | −0.0652 | 9.6955 |
| 1.4839 | −0.0673 | 9.6955 |
| 1.4830 | −0.0715 | 9.6955 |
| 1.4799 | −0.0772 | 9.6955 |
| 1.4703 | −0.0839 | 9.6955 |
| 1.4548 | −0.0863 | 9.6955 |
| 1.4339 | −0.0890 | 9.6955 |
| 1.4079 | −0.0921 | 9.6955 |
| 1.3740 | −0.0960 | 9.6955 |
| 1.3350 | −0.1009 | 9.6955 |
| 1.2934 | −0.1066 | 9.6955 |
| 1.2467 | −0.1127 | 9.6955 |
| 1.1947 | −0.1189 | 9.6955 |
| 1.1375 | −0.1255 | 9.6955 |
| 1.0777 | −0.1318 | 9.6955 |
| 1.0153 | −0.1375 | 9.6955 |
| 0.9503 | −0.1426 | 9.6955 |
| 0.8827 | −0.1468 | 9.6955 |
| 0.8125 | −0.1498 | 9.6955 |
| 0.7396 | −0.1515 | 9.6955 |
| 0.6641 | −0.1515 | 9.6955 |
| 0.5860 | −0.1494 | 9.6955 |
| 0.5078 | −0.1448 | 9.6955 |
| 0.4296 | −0.1377 | 9.6955 |
| 0.3514 | −0.1287 | 9.6955 |
| 0.2731 | −0.1180 | 9.6955 |
| 0.1951 | −0.1060 | 9.6955 |
| 0.1174 | −0.0926 | 9.6955 |
| 0.0400 | −0.0778 | 9.6955 |
| −0.0369 | −0.0616 | 9.6955 |
| −0.1135 | −0.0441 | 9.6955 |
| −0.1898 | −0.0253 | 9.6955 |
| −0.2656 | −0.0051 | 9.6955 |
| −0.3386 | 0.0157 | 9.6955 |
| −0.4088 | 0.0369 | 9.6955 |
| −0.4761 | 0.0586 | 9.6955 |
| −0.5407 | 0.0806 | 9.6955 |
| −0.6024 | 0.1029 | 9.6955 |
| −0.6615 | 0.1253 | 9.6955 |
| −0.7177 | 0.1477 | 9.6955 |
| −0.7689 | 0.1690 | 9.6955 |
| −0.8147 | 0.1892 | 9.6955 |
| −0.8554 | 0.2079 | 9.6955 |
| −0.8911 | 0.2250 | 9.6955 |
| −0.9217 | 0.2403 | 9.6955 |
| −0.9475 | 0.2537 | 9.6955 |
| −0.9693 | 0.2655 | 9.6955 |
| −0.9875 | 0.2757 | 9.6955 |
| −1.0023 | 0.2844 | 9.6955 |
| −1.0139 | 0.2918 | 9.6955 |
| −1.0223 | 0.2981 | 9.6955 |
| −1.0281 | 0.3036 | 9.6955 |
| −1.0322 | 0.3088 | 9.6955 |
| −1.0343 | 0.3137 | 9.6955 |
| −1.0340 | 0.3177 | 9.6955 |
| −1.0316 | 0.3206 | 9.6955 |
| −1.0269 | 0.3227 | 9.6955 |
| −1.0206 | 0.3237 | 9.6955 |
| −1.0129 | 0.3237 | 9.6955 |
| −1.0027 | 0.3226 | 9.6955 |
| −0.9896 | 0.3202 | 9.6955 |
| −0.9733 | 0.3165 | 9.6955 |
| −0.9536 | 0.3119 | 9.6955 |
| −0.9302 | 0.3062 | 9.6955 |
| −0.9029 | 0.2992 | 9.6955 |
| −0.8706 | 0.2909 | 9.6955 |
| −0.8334 | 0.2811 | 9.6955 |

TABLE A-continued

| X | Y | Z |
|---|---|---|
| −0.7912 | 0.2701 | 9.6955 |
| −0.7441 | 0.2577 | 9.6955 |
| −0.6919 | 0.2441 | 9.6955 |
| −0.6348 | 0.2295 | 9.6955 |
| −0.5751 | 0.2147 | 9.6955 |
| −0.5127 | 0.1997 | 9.6955 |
| −0.4478 | 0.1847 | 9.6955 |
| −0.3803 | 0.1695 | 9.6955 |
| −0.3101 | 0.1544 | 9.6955 |
| −0.2372 | 0.1394 | 9.6955 |
| −0.1617 | 0.1246 | 9.6955 |
| −0.0861 | 0.1105 | 9.6955 |
| −0.0104 | 0.0972 | 9.6955 |
| 0.0655 | 0.0847 | 9.6955 |
| 0.1415 | 0.0729 | 9.6955 |
| 0.2177 | 0.0619 | 9.6955 |
| 0.2939 | 0.0518 | 9.6955 |
| 0.3702 | 0.0424 | 9.6955 |
| 0.4466 | 0.0338 | 9.6955 |
| 0.5231 | 0.0254 | 9.6955 |
| 0.5995 | 0.0167 | 9.6955 |
| 0.6758 | 0.0077 | 9.6955 |
| 0.7496 | −0.0010 | 9.6955 |
| 0.8210 | −0.0090 | 9.6955 |
| 0.8898 | −0.0165 | 9.6955 |
| 0.9561 | −0.0232 | 9.6955 |
| 1.0199 | −0.0291 | 9.6955 |
| 1.0811 | −0.0343 | 9.6955 |
| 1.1399 | −0.0386 | 9.6955 |
| 1.1962 | −0.0421 | 9.6955 |
| 1.2474 | −0.0446 | 9.6955 |
| 1.2935 | −0.0464 | 9.6955 |
| 1.3345 | −0.0476 | 9.6955 |
| 1.3729 | −0.0478 | 9.6955 |
| 1.4062 | −0.0471 | 9.6955 |
| 1.4319 | −0.0465 | 9.6955 |
| 1.4524 | −0.0460 | 9.6955 |
| 1.4678 | −0.0460 | 9.6955 |
| 1.4780 | −0.0511 | 9.6955 |
| 1.4818 | −0.0563 | 9.6955 |
| 1.4833 | −0.0601 | 9.6955 |
| 1.4837 | −0.0621 | 9.6955 |
| 1.4839 | −0.0631 | 9.6955 |
| 1.4839 | −0.0636 | 9.6955 |
| 1.4787 | −0.0704 | 9.8955 |
| 1.4788 | −0.0715 | 9.8955 |
| 1.4786 | −0.0736 | 9.8955 |
| 1.4777 | −0.0777 | 9.8955 |
| 1.4746 | −0.0834 | 9.8955 |
| 1.4650 | −0.0900 | 9.8955 |
| 1.4495 | −0.0924 | 9.8955 |
| 1.4288 | −0.0951 | 9.8955 |
| 1.4028 | −0.0982 | 9.8955 |
| 1.3691 | −0.1022 | 9.8955 |
| 1.3302 | −0.1072 | 9.8955 |
| 1.2888 | −0.1130 | 9.8955 |
| 1.2422 | −0.1191 | 9.8955 |
| 1.1904 | −0.1255 | 9.8955 |
| 1.1334 | −0.1322 | 9.8955 |
| 1.0738 | −0.1385 | 9.8955 |
| 1.0117 | −0.1443 | 9.8955 |
| 0.9469 | −0.1494 | 9.8955 |
| 0.8795 | −0.1535 | 9.8955 |
| 0.8096 | −0.1564 | 9.8955 |
| 0.7370 | −0.1577 | 9.8955 |
| 0.6618 | −0.1571 | 9.8955 |
| 0.5840 | −0.1541 | 9.8955 |
| 0.5061 | −0.1486 | 9.8955 |
| 0.4283 | −0.1407 | 9.8955 |
| 0.3504 | −0.1311 | 9.8955 |
| 0.2725 | −0.1200 | 9.8955 |
| 0.1948 | −0.1076 | 9.8955 |
| 0.1174 | −0.0937 | 9.8955 |
| 0.0405 | −0.0785 | 9.8955 |
| −0.0361 | −0.0620 | 9.8955 |
| −0.1123 | −0.0441 | 9.8955 |
| −0.1882 | −0.0249 | 9.8955 |
| −0.2637 | −0.0044 | 9.8955 |

TABLE A-continued

| X | Y | Z |
|---|---|---|
| −0.3363 | 0.0167 | 9.8955 |
| −0.4061 | 0.0383 | 9.8955 |
| −0.4731 | 0.0603 | 9.8955 |
| −0.5373 | 0.0826 | 9.8955 |
| −0.5987 | 0.1051 | 9.8955 |
| −0.6574 | 0.1276 | 9.8955 |
| −0.7134 | 0.1503 | 9.8955 |
| −0.7642 | 0.1718 | 9.8955 |
| −0.8098 | 0.1921 | 9.8955 |
| −0.8502 | 0.2110 | 9.8955 |
| −0.8857 | 0.2282 | 9.8955 |
| −0.9162 | 0.2436 | 9.8955 |
| −0.9418 | 0.2570 | 9.8955 |
| −0.9635 | 0.2689 | 9.8955 |
| −0.9815 | 0.2792 | 9.8955 |
| −0.9962 | 0.2879 | 9.8955 |
| −1.0077 | 0.2953 | 9.8955 |
| −1.0161 | 0.3017 | 9.8955 |
| −1.0219 | 0.3071 | 9.8955 |
| −1.0259 | 0.3123 | 9.8955 |
| −1.0280 | 0.3172 | 9.8955 |
| −1.0277 | 0.3212 | 9.8955 |
| −1.0252 | 0.3241 | 9.8955 |
| −1.0206 | 0.3261 | 9.8955 |
| −1.0143 | 0.3271 | 9.8955 |
| −1.0066 | 0.3271 | 9.8955 |
| −0.9965 | 0.3259 | 9.8955 |
| −0.9834 | 0.3235 | 9.8955 |
| −0.9672 | 0.3198 | 9.8955 |
| −0.9476 | 0.3151 | 9.8955 |
| −0.9243 | 0.3093 | 9.8955 |
| −0.8971 | 0.3023 | 9.8955 |
| −0.8650 | 0.2938 | 9.8955 |
| −0.8280 | 0.2840 | 9.8955 |
| −0.7860 | 0.2728 | 9.8955 |
| −0.7391 | 0.2603 | 9.8955 |
| −0.6873 | 0.2466 | 9.8955 |
| −0.6304 | 0.2318 | 9.8955 |
| −0.5710 | 0.2168 | 9.8955 |
| −0.5089 | 0.2017 | 9.8955 |
| −0.4443 | 0.1864 | 9.8955 |
| −0.3771 | 0.1711 | 9.8955 |
| −0.3072 | 0.1558 | 9.8955 |
| −0.2347 | 0.1406 | 9.8955 |
| −0.1596 | 0.1256 | 9.8955 |
| −0.0843 | 0.1113 | 9.8955 |
| −0.0089 | 0.0978 | 9.8955 |
| 0.0666 | 0.0850 | 9.8955 |
| 0.1423 | 0.0731 | 9.8955 |
| 0.2181 | 0.0619 | 9.8955 |
| 0.2940 | 0.0516 | 9.8955 |
| 0.3700 | 0.0421 | 9.8955 |
| 0.4460 | 0.0333 | 9.8955 |
| 0.5222 | 0.0250 | 9.8955 |
| 0.5983 | 0.0167 | 9.8955 |
| 0.6744 | 0.0080 | 9.8955 |
| 0.7479 | −0.0007 | 9.8955 |
| 0.8189 | −0.0090 | 9.8955 |
| 0.8874 | −0.0169 | 9.8955 |
| 0.9534 | −0.0241 | 9.8955 |
| 1.0168 | −0.0306 | 9.8955 |
| 1.0778 | −0.0364 | 9.8955 |
| 1.1363 | −0.0414 | 9.8955 |
| 1.1923 | −0.0455 | 9.8955 |
| 1.2432 | −0.0485 | 9.8955 |
| 1.2891 | −0.0508 | 9.8955 |
| 1.3299 | −0.0525 | 9.8955 |
| 1.3682 | −0.0531 | 9.8955 |
| 1.4014 | −0.0528 | 9.8955 |
| 1.4270 | −0.0524 | 9.8955 |
| 1.4474 | −0.0521 | 9.8955 |
| 1.4627 | −0.0523 | 9.8955 |
| 1.4728 | −0.0574 | 9.8955 |
| 1.4766 | −0.0626 | 9.8955 |
| 1.4781 | −0.0664 | 9.8955 |
| 1.4785 | −0.0684 | 9.8955 |
| 1.4787 | −0.0694 | 9.8955 |
| 1.4787 | −0.0699 | 9.8955 |

TABLE A-continued

| X | Y | Z |
|---|---|---|
| 1.4600 | −0.0921 | 10.5995 |
| 1.4600 | −0.0932 | 10.5995 |
| 1.4598 | −0.0952 | 10.5995 |
| 1.4588 | −0.0992 | 10.5995 |
| 1.4556 | −0.1047 | 10.5995 |
| 1.4459 | −0.1109 | 10.5995 |
| 1.4304 | −0.1131 | 10.5995 |
| 1.4098 | −0.1158 | 10.5995 |
| 1.3839 | −0.1191 | 10.5995 |
| 1.3504 | −0.1235 | 10.5995 |
| 1.3117 | −0.1292 | 10.5995 |
| 1.2706 | −0.1356 | 10.5995 |
| 1.2242 | −0.1426 | 10.5995 |
| 1.1726 | −0.1500 | 10.5995 |
| 1.1159 | −0.1578 | 10.5995 |
| 1.0564 | −0.1651 | 10.5995 |
| 0.9943 | −0.1716 | 10.5995 |
| 0.9294 | −0.1769 | 10.5995 |
| 0.8620 | −0.1807 | 10.5995 |
| 0.7923 | −0.1825 | 10.5995 |
| 0.7202 | −0.1819 | 10.5995 |
| 0.6459 | −0.1780 | 10.5995 |
| 0.5694 | −0.1700 | 10.5995 |
| 0.4932 | −0.1598 | 10.5995 |
| 0.4170 | −0.1489 | 10.5995 |
| 0.3409 | −0.1371 | 10.5995 |
| 0.2650 | −0.1241 | 10.5995 |
| 0.1891 | −0.1099 | 10.5995 |
| 0.1134 | −0.0944 | 10.5995 |
| 0.0379 | −0.0778 | 10.5995 |
| −0.0373 | −0.0599 | 10.5995 |
| −0.1121 | −0.0408 | 10.5995 |
| −0.1865 | −0.0206 | 10.5995 |
| −0.2605 | 0.0010 | 10.5995 |
| −0.3316 | 0.0230 | 10.5995 |
| −0.3999 | 0.0454 | 10.5995 |
| −0.4654 | 0.0682 | 10.5995 |
| −0.5280 | 0.0913 | 10.5995 |
| −0.5879 | 0.1146 | 10.5995 |
| −0.6451 | 0.1379 | 10.5995 |
| −0.6996 | 0.1613 | 10.5995 |
| −0.7490 | 0.1836 | 10.5995 |
| −0.7934 | 0.2046 | 10.5995 |
| −0.8328 | 0.2239 | 10.5995 |
| −0.8674 | 0.2415 | 10.5995 |
| −0.8971 | 0.2572 | 10.5995 |
| −0.9220 | 0.2708 | 10.5995 |
| −0.9431 | 0.2828 | 10.5995 |
| −0.9607 | 0.2932 | 10.5995 |
| −0.9750 | 0.3020 | 10.5995 |
| −0.9863 | 0.3094 | 10.5995 |
| −0.9945 | 0.3157 | 10.5995 |
| −1.0002 | 0.3210 | 10.5995 |
| −1.0043 | 0.3261 | 10.5995 |
| −1.0064 | 0.3308 | 10.5995 |
| −1.0061 | 0.3347 | 10.5995 |
| −1.0035 | 0.3375 | 10.5995 |
| −0.9988 | 0.3392 | 10.5995 |
| −0.9926 | 0.3399 | 10.5995 |
| −0.9851 | 0.3397 | 10.5995 |
| −0.9751 | 0.3383 | 10.5995 |
| −0.9623 | 0.3357 | 10.5995 |
| −0.9463 | 0.3319 | 10.5995 |
| −0.9270 | 0.3271 | 10.5995 |
| −0.9041 | 0.3210 | 10.5995 |
| −0.8774 | 0.3138 | 10.5995 |
| −0.8458 | 0.3050 | 10.5995 |
| −0.8095 | 0.2947 | 10.5995 |
| −0.7683 | 0.2831 | 10.5995 |
| −0.7222 | 0.2701 | 10.5995 |
| −0.6713 | 0.2559 | 10.5995 |
| −0.6154 | 0.2404 | 10.5995 |
| −0.5571 | 0.2246 | 10.5995 |
| −0.4962 | 0.2086 | 10.5995 |
| −0.4327 | 0.1925 | 10.5995 |
| −0.3667 | 0.1763 | 10.5995 |
| −0.2980 | 0.1601 | 10.5995 |
| −0.2268 | 0.1440 | 10.5995 |

TABLE A-continued

| X | Y | Z |
|---|---|---|
| −0.1529 | 0.1282 | 10.5995 |
| −0.0789 | 0.1131 | 10.5995 |
| −0.0047 | 0.0988 | 10.5995 |
| 0.0696 | 0.0853 | 10.5995 |
| 0.1441 | 0.0728 | 10.5995 |
| 0.2187 | 0.0611 | 10.5995 |
| 0.2935 | 0.0504 | 10.5995 |
| 0.3683 | 0.0406 | 10.5995 |
| 0.4433 | 0.0317 | 10.5995 |
| 0.5184 | 0.0241 | 10.5995 |
| 0.5937 | 0.0178 | 10.5995 |
| 0.6690 | 0.0113 | 10.5995 |
| 0.7415 | 0.0029 | 10.5995 |
| 0.8114 | −0.0062 | 10.5995 |
| 0.8787 | −0.0154 | 10.5995 |
| 0.9435 | −0.0245 | 10.5995 |
| 1.0058 | −0.0332 | 10.5995 |
| 1.0656 | −0.0413 | 10.5995 |
| 1.1230 | −0.0487 | 10.5995 |
| 1.1780 | −0.0553 | 10.5995 |
| 1.2280 | −0.0607 | 10.5995 |
| 1.2731 | −0.0650 | 10.5995 |
| 1.3133 | −0.0686 | 10.5995 |
| 1.3509 | −0.0711 | 10.5995 |
| 1.3836 | −0.0724 | 10.5995 |
| 1.4088 | −0.0732 | 10.5995 |
| 1.4289 | −0.0737 | 10.5995 |
| 1.4440 | −0.0743 | 10.5995 |
| 1.4541 | −0.0793 | 10.5995 |
| 1.4579 | −0.0843 | 10.5995 |
| 1.4594 | −0.0881 | 10.5995 |
| 1.4598 | −0.0901 | 10.5995 |
| 1.4599 | −0.0911 | 10.5995 |
| 1.4600 | −0.0916 | 10.5995 |

Via development of source codes, models and design practices, a loci of 1456 points in space that meet the unique demands of the third stage requirements of compressor 12 has been determined in an iterative process considering aerodynamic loading and mechanical loading of the blades under applicable operating parameters. The loci of points is believed to achieve a desired interaction between other stages in the compressor, aerodynamic efficiency of the compressor; and optimal aerodynamic and mechanical loading of the stator vanes during compressor operation. Additionally, the loci of points provide a manufacturable airfoil profile for fabrication of the stator vanes, and allows the compressor to run in an efficient, safe and smooth manner.

For example, but in no way limiting of the invention, the airfoil configuration (with or without fluid flow interaction) can be determined by computational modeling, Fluid Dynamics (CFD); traditional fluid dynamics analysis; Euler and Navier-Stokes equations; for transfer functions, algorithms, manufacturing: manual positioning, flow testing (for example in wind tunnels), and modification of the airfoil; in-situ testing; modeling: application of scientific principles to design or develop the airfoils, machines, apparatus, or manufacturing processes; airfoil flow testing and modification; combinations thereof, and other design processes and practices. These methods of determination are merely exemplary, and are not intended to limit the invention in any manner.

In the exemplary embodiments, as embodied by the invention, for example the stage compressor vane, there are many airfoils, which are un-cooled. For reference purposes only, there is established point-0 passing through the intersection of the airfoil and the platform along the stacking axis.

The airfoil, as embodied by the present invention, can be scaled up, or scaled down geometrically for introduction into similar turbine designs. Consequently, the X, Y and Z coordinates of the nominal airfoil profile may be a function of a constant. That is, the X, Y and Z coordinate values may be multiplied or divided by the same constant or number to provide a "scaled-up" or "scaled-down" version of the vane airfoil profile, while retaining the airfoil section shape, as embodied by the invention. For example, the airfoil as defined by TABLE A, can be applied in a compressor of a turbine, for example, but not limited to, as General Electric "7FA+e" compressor. Moreover, the vane airfoil profile, as embodied by the invention, can comprise a stage 3 stator vane of a compressor. This compressor is merely illustrative of the intended applications for the airfoil, as embodied by the invention. Moreover, it is envisioned that the airfoil of TABLE A, as embodied by the invention, can also be used as stator vanes in GE Frame F-class turbines, as well as GE's Frame 6 and 9 turbines, given the scaling of the airfoil, as embodied by the invention.

In addition, and as noted previously, the airfoil may also be coated for protection against corrosion and oxidation after the airfoil is manufactured, according to the values of Table A and within the tolerances explained above. In an exemplary embodiment, an anti-corrosion coating or coatings is provided with a total average thickness of about 0.100 inches. Consequently, in addition to the manufacturing tolerances for the X and Y values set forth in Table A, there is also an addition to those values to account for the coating thicknesses. It is contemplated that greater or lesser coating thickness values may be employed in alternative embodiments of the invention.

As the third stage stator vane assembly, including the aforementioned airfoils, heats up during operation, applied stress and temperature on the turbine blades inevitably leads to some deformation of the airfoil shape, and hence there is some change or displacement in the X, Y and Z coordinates set forth in Table A as the engine is operated. While it is not possible to measure the changes in the airfoil coordinates in operation, it has been determined that the loci of points set forth in Table A plus the deformation in use, allows the compressor to run in an efficient, safe and smooth manner.

The above-described stator vanes provide a cost-effective and reliable method for optimizing performance of a rotor assembly. More specifically, each stator vane airfoil has an airfoil shape that facilitates achieving a desired interaction between other stages in the compressor, aerodynamic efficiency of the compressor; and optimal aerodynamic and mechanical loading of the stator vanes during compressor operation. As a result, the redefined airfoil geometry facilitates extending a useful life of the stator assembly and improving the operating efficiency of the compressor in a cost-effective and reliable manner.

Exemplary embodiments of stator vanes and stator assemblies are described above in detail. The stator vanes are not limited to the specific embodiments described herein, but rather, components of each stator vane may be utilized independently and separately from other components described herein. For example, each stator vane recessed portion can also be defined in, or used in combination with, other stator vanes or with other rotor assemblies, and is not limited to practice with only the stator vanes described herein. Rather, the present invention can be implemented and utilized in connection with many other vane and rotor configurations.

Moreover, and as noted above, the airfoil configuration (along with its interaction with surrounding airfoils), as embodied by the invention, including its peripheral surface provides for stage airflow efficiency, enhanced aeromechanics, smooth laminar flow from stage to stage, reduced thermal stresses, enhanced interrelation of the stages to effectively pass the airflow from stage to stage, and reduced mechanical stresses, among other desirable aspects of the invention, compared to other similar airfoils, which have like applications. Of course, other such advantages are within the scope of the invention.

While the invention has been described in terms of various specific embodiments, those skilled in the art will recognize that the invention can be practiced with modification within the spirit and scope of the claims.

What is claimed is:

1. An airfoil for a stator vane having an uncoated profile substantially in accordance with Cartesian coordinate values of X, Y and Z set forth in Table I carried only to four decimal places wherein Z is a distance from a platform on which the airfoil is mounted and X and Y are coordinates defining the profile at each distance Z from the platform.

2. An airfoil in accordance with claim 1 wherein said airfoil comprises a third stage of a compressor.

3. An airfoil in accordance with claim 1 wherein said airfoil profile lies in an envelope within +/−0. 160 inches in a direction normal to any airfoil surface location.

4. An airfoil in accordance with claim 1 wherein said airfoil profile facilitates optimizing an aerodynamic efficiency of said airfoil.

5. An airfoil in accordance with claim 1 in combination with a base extending integrally from said platform, said airfoil being formed via a casting process.

6. A compressor comprising at least one row of stator vanes wherein each of said stator vanes comprises a base and an airfoil extending therefrom, at least one of said airfoils having an airfoil shape, said airfoil shape having a nominal profile substantially in accordance with Cartesian coordinate values of X, Y and Z set forth in Table I carried only to three decimal places wherein Z is a distance from an upper surface of said base from which said airfoil extends and X and Y are coordinates defining the profile at each distance Z from said base.

7. A compressor in accordance with claim 6 wherein each said airfoil shape is defined by the profile sections at the Z distances being joined smoothly with one another to form a complete airfoil shape.

8. A compressor in accordance with claim 6 wherein said at least one airfoil further comprises a coating extending upon said at least one airfoil, said coating having a thickness of about 0.100 inches or less.

9. A compressor in accordance with claim 6 wherein said at least one row of stator vanes comprises a third stage of said compressor.

10. A compressor in accordance with claim 6 wherein said airfoil profile lies in an envelope within +/−0.160 inches in a direction normal to any airfoil surface location.

11. A compressor in accordance with claim 6 wherein said airfoil shape facilitates improving an operating efficiency of said compressor.

12. A compressor in accordance with claim 6 wherein said airfoil shape facilitates optimizing an aerodynamic efficiency of said airfoil.

13. A compressor in accordance with claim 6 wherein each said stator vane base is cast integrally with a respective one of said airfoils.

14. A stator assembly comprising at least one stator vane comprising a base and an airfoil extending from said base, wherein said airfoil comprises an uncoated profile substantially in accordance with Cartesian coordinate values of X, Y and Z set forth in Table I carried only to three decimal places wherein Z is a distance from an upper surface of said from which said airfoil extends and X and Y are coordinates defining the profile at each distance Z from said base, said profile scalable by a predetermined constant n and manufacturable to a predetermined manufacturing tolerance.

15. A stator assembly in accordance with claim 14 wherein said predetermined manufacturing tolerance is about ±0.160 inches.

16. A stator assembly in accordance with claim 14 wherein said stator assembly forms a portion of a compressor, said stator assembly comprises a portion of a third stage of the compressor.

17. A stator assembly in accordance with claim 14 further comprising a coating upon said airfoil, said coating having a thickness of about 0.100 inches or less.

* * * * *

UNITED STATES PATENT AND TRADEMARK OFFICE

CERTIFICATE OF CORRECTION

PATENT NO. : 8,113,786 B2
APPLICATION NO. : 12/209355
DATED : February 14, 2012
INVENTOR(S) : Spracher et al.

It is certified that error appears in the above-identified patent and that said Letters Patent is hereby corrected as shown below:

In Claim 3, column 35, line 21, delete "within +/-0. 160 inches" and insert therefor
-- within +/-0.160 inches --.

Signed and Sealed this
Seventeenth Day of April, 2012

David J. Kappos

David J. Kappos
*Director of the United States Patent and Trademark Office*